US008233642B2

(12) United States Patent
Mao

(10) Patent No.: US 8,233,642 B2
(45) **Date of Patent: *Jul. 31, 2012**

(54) METHODS AND APPARATUSES FOR CAPTURING AN AUDIO SIGNAL BASED ON A LOCATION OF THE SIGNAL

(75) Inventor: Xiao Dong Mao, Foster City, CA (US)

(73) Assignee: Sony Computer Entertainment Inc., Tokyo (JP)

( * ) Notice: Subject to any disclaimer, the term of this patent is extended or adjusted under 35 U.S.C. 154(b) by 1260 days.

This patent is subject to a terminal disclaimer.

(21) Appl. No.: 11/429,047

(22) Filed: May 4, 2006

(65) Prior Publication Data

US 2006/0269073 A1 Nov. 30, 2006

Related U.S. Application Data

(63) Continuation-in-part of application No. 10/650,409, filed on Aug. 27, 2003, now Pat. No. 7,613,310, and a continuation-in-part of application No. 10/820,469, filed on Apr. 7, 2004, now Pat. No. 7,970,147.

(60) Provisional application No. 60/678,413, filed on May 5, 2005, provisional application No. 60/718,145, filed on Sep. 15, 2005.

(51) Int. Cl.
*H04R 3/00* (2006.01)
*H04R 29/00* (2006.01)

(52) U.S. Cl. ..... 381/122; 381/92; 381/56

(58) Field of Classification Search ..... 381/92, 381/103, 59, 303, 307, 77, 122, 56–58; 348/11, 348/14.8, 15; 345/418

See application file for complete search history.

(56) References Cited

U.S. PATENT DOCUMENTS 4,624,012 A 11/1986 Lin et al.

(Continued)

FOREIGN PATENT DOCUMENTS

EP 0353200 A2 1/1990

(Continued)

OTHER PUBLICATIONS

United States Patent and Trademark Office; "Non-Final Office Action" issued in U.S. Appl. No. 11/418,989, which published as U.S. Pub. No. 2006/0280312A1; dated Aug. 6, 2008; 9 pages.

United States Patent and Trademark Office; "Non-Final Office Action" issued in U.S. Appl. No. 11/418,988, which published as U.S. Pub. No. 2006/0269072A1; dated Aug. 26, 2008; 5 pages.

USPTO; Advisory Action issued in U.S. Appl. No. 11/418,988; mailed Jul. 1, 2009; 2 pages.

USPTO; Office Action issued in U.S. Appl. No. 11/418,988; mailed Sep. 21, 2009; 6 pages.

(Continued)

*Primary Examiner* — Devona Faulk
*Assistant Examiner* — George Monikang
(74) *Attorney, Agent, or Firm* — Fitch, Even, Tabin & Flannery, LLP

(57) ABSTRACT

In one embodiment, the methods and apparatuses detect an initial listening zone wherein the initial listening zone represents an initial area monitored for sounds; detect an initial sound within the initial listening zone; and adjust the initial listening zone and forming the adjusted listening zone having an adjusted area based wherein the initial sound emanates from within the adjusted listening zone.

29 Claims, 15 Drawing Sheets

U.S. PATENT DOCUMENTS

| | | | | |
|---|---|---|---|---|
| 4,963,858 | A | 10/1990 | Chien | |
| 5,018,736 | A | 5/1991 | Pearson et al. | |
| 5,113,449 | A | 5/1992 | Blanton et al. | |
| 5,128,671 | A | 7/1992 | Thomas, Jr. | |
| 5,144,114 | A | 9/1992 | Wittensoldner et al. | |
| 5,214,615 | A | 5/1993 | Bauer | |
| 5,227,985 | A | 7/1993 | DeMenthon | |
| 5,262,777 | A | 11/1993 | Low et al. | |
| 5,296,871 | A | 3/1994 | Paley | |
| 5,327,521 | A | 7/1994 | Savic et al. | |
| 5,335,011 | A | 8/1994 | Addeo et al. | |
| 5,388,059 | A | 2/1995 | DeMenthon | |
| 5,394,168 | A | 2/1995 | Smith et al. | |
| 5,425,130 | A | 6/1995 | Morgan | |
| 5,453,758 | A | 9/1995 | Sato | |
| 5,485,273 | A | 1/1996 | Mark et al. | |
| 5,534,917 | A | 7/1996 | MacDougall | |
| 5,554,980 | A | 9/1996 | Hashimoto et al. | |
| 5,563,988 | A | 10/1996 | Maes et al. | |
| 5,611,731 | A | 3/1997 | Bouton et al. | |
| 5,649,021 | A | 7/1997 | Matey et al. | |
| 5,694,474 | A | 12/1997 | Ngo et al. | |
| 5,768,415 | A | 6/1998 | Jagadish et al. | |
| 5,850,222 | A | 12/1998 | Cone | |
| 5,900,863 | A | 5/1999 | Numazaki | |
| 5,913,727 | A | 6/1999 | Ahdoot | |
| 5,916,024 | A | 6/1999 | Von Kohorn | |
| 5,917,936 | A | 6/1999 | Katto | |
| 5,930,383 | A | 7/1999 | Netzer | |
| 5,959,667 | A | 9/1999 | Maeng | |
| 5,991,693 | A | 11/1999 | Zalewski | |
| 5,993,314 | A | 11/1999 | Dannenberg | |
| 6,002,776 | A | 12/1999 | Bhadkamkar et al. | |
| 6,009,210 | A | 12/1999 | Kang | |
| 6,009,396 | A | 12/1999 | Nagata | |
| 6,014,167 | A | 1/2000 | Suito et al. | |
| 6,014,623 | A | 1/2000 | Wu et al. | |
| 6,022,274 | A | 2/2000 | Takeda et al. | |
| 6,057,909 | A | 5/2000 | Yahav et al. | |
| 6,061,055 | A | 5/2000 | Marks | |
| 6,069,594 | A | 5/2000 | Barnes et al. | |
| 6,075,895 | A | 6/2000 | Qiao et al. | |
| 6,081,780 | A | 6/2000 | Lumelsky | |
| 6,100,895 | A | 8/2000 | Miuara et al. | |
| 6,115,684 | A | 9/2000 | Kawahara et al. | |
| 6,144,367 | A | 11/2000 | Berstis | |
| 6,173,059 | B1 | 1/2001 | Huang et al. | |
| 6,188,442 | B1 | 2/2001 | Narayanaswami | |
| 6,195,104 | B1 | 2/2001 | Lyons | |
| 6,243,491 | B1 | 6/2001 | Andersson | |
| 6,304,267 | B1 | 10/2001 | Sata | |
| 6,317,703 | B1 | 11/2001 | Linsker | |
| 6,332,028 | B1 | 12/2001 | Marash | |
| 6,336,092 | B1 | 1/2002 | Gibson et al. | |
| 6,339,758 | B1 | 1/2002 | Kanazawa et al. | |
| 6,346,929 | B1 | 2/2002 | Fukushima et al. | |
| 6,371,849 | B1 | 4/2002 | Togami | |
| 6,392,644 | B1 | 5/2002 | Miyata | |
| 6,394,897 | B1 | 5/2002 | Togami | |
| 6,400,374 | B2 | 6/2002 | Lanier | |
| 6,411,744 | B1 | 6/2002 | Edwards | |
| 6,417,836 | B1 | 7/2002 | Kumar et al. | |
| 6,441,825 | B1 | 8/2002 | Peters | |
| 6,489,948 | B1 | 12/2002 | Lau | |
| 6,545,706 | B1 | 4/2003 | Edwards et al. | |
| 6,573,883 | B1 | 6/2003 | Bartlett | |
| 6,597,342 | B1 | 7/2003 | Haruta | |
| 6,618,073 | B1 * | 9/2003 | Lambert et al. | 348/14.08 |
| 6,699,123 | B2 | 3/2004 | Matsuura et al. | |
| 6,720,949 | B1 | 4/2004 | Pryor et al. | |
| 6,791,531 | B1 | 9/2004 | Johnston et al. | |
| 6,890,262 | B2 | 5/2005 | Oishi et al. | |
| 6,931,362 | B2 | 8/2005 | Beadle et al. | |
| 6,934,397 | B2 | 8/2005 | Madievski et al. | |
| 6,990,639 | B2 | 1/2006 | Wilson | |
| 7,004,839 | B2 | 2/2006 | Suzuki et al. | |
| 7,035,415 | B2 | 4/2006 | Belt et al. | |
| 7,038,661 | B2 | 5/2006 | Wilson et al. | |
| 7,042,440 | B2 | 5/2006 | Pryor et al. | |
| 7,088,831 | B2 | 8/2006 | Rosca et al. | |
| 7,092,882 | B2 * | 8/2006 | Arrowood et al. | 704/233 |
| 7,102,615 | B2 | 9/2006 | Marks | |
| 7,212,956 | B2 | 5/2007 | Bruno et al. | |
| 7,227,976 | B1 | 6/2007 | Jung et al. | |
| 7,233,316 | B2 | 6/2007 | Smith et al. | |
| 7,259,375 | B2 | 8/2007 | Tichit et al. | |
| 7,280,964 | B2 | 10/2007 | Wilson et al. | |
| D571,367 | S | 6/2008 | Goto et al. | |
| D571,806 | S | 6/2008 | Goto | |
| 7,386,135 | B2 | 6/2008 | Fan | |
| D572,254 | S | 7/2008 | Goto | |
| 7,414,596 | B2 | 8/2008 | Satoh et al. | |
| 7,489,299 | B2 | 2/2009 | Liberty et al. | |
| 7,545,926 | B2 | 6/2009 | Mao | |
| 7,623,115 | B2 | 11/2009 | Marks | |
| 7,627,139 | B2 | 12/2009 | Marks et al. | |
| 7,678,983 | B2 | 3/2010 | Komori et al. | |
| 7,697,700 | B2 | 4/2010 | Mao | |
| 7,783,061 | B2 | 8/2010 | Zalewski et al. | |
| 7,803,050 | B2 | 9/2010 | Mao | |
| 7,809,145 | B2 | 10/2010 | Mao | |
| 7,918,733 | B2 | 4/2011 | Zalewski et al. | |
| 8,073,157 | B2 | 12/2011 | Mao et al. | |
| 8,139,793 | B2 | 3/2012 | Mao | |
| 2002/0024500 | A1 | 2/2002 | Haward | |
| 2002/0041327 | A1 | 4/2002 | Hildreth et al. | |
| 2002/0048376 | A1 | 4/2002 | Ukita | |
| 2002/0051119 | A1 | 5/2002 | Sherman et al. | |
| 2002/0109680 | A1 * | 8/2002 | Orbanes et al. | 345/418 |
| 2002/0110273 | A1 | 8/2002 | Dufour | |
| 2002/0159608 | A1 | 10/2002 | Fado et al. | |
| 2003/0020718 | A1 | 1/2003 | Marshall et al. | |
| 2003/0022716 | A1 | 1/2003 | Park et al. | |
| 2003/0031333 | A1 | 2/2003 | Cohen et al. | |
| 2003/0032466 | A1 | 2/2003 | Watashiba | |
| 2003/0032484 | A1 | 2/2003 | Ohshima et al. | |
| 2003/0046038 | A1 | 3/2003 | Deligne et al. | |
| 2003/0050118 | A1 | 3/2003 | Suzuki et al. | |
| 2003/0055646 | A1 | 3/2003 | Yoshioka et al. | |
| 2003/0063065 | A1 | 4/2003 | Lee et al. | |
| 2003/0100363 | A1 | 5/2003 | Ali | |
| 2003/0108214 | A1 * | 6/2003 | Brennan et al. | 381/94.7 |
| 2003/0160862 | A1 | 8/2003 | Charlier et al. | |
| 2003/0179891 | A1 * | 9/2003 | Rabinowitz et al. | 381/103 |
| 2003/0193572 | A1 | 10/2003 | Wilson et al. | |
| 2004/0029640 | A1 | 2/2004 | Masuyama et al. | |
| 2004/0037183 | A1 | 2/2004 | Tanaka et al. | |
| 2004/0046736 | A1 | 3/2004 | Pryor | |
| 2004/0047464 | A1 | 3/2004 | Yu et al. | |
| 2004/0063502 | A1 | 4/2004 | Hussaini | |
| 2004/0070564 | A1 | 4/2004 | Dawson et al. | |
| 2004/0075677 | A1 | 4/2004 | Loyall et al. | |
| 2004/0155962 | A1 | 8/2004 | Marks | |
| 2004/0161121 | A1 * | 8/2004 | Chol et al. | 381/92 |
| 2004/0178576 | A1 | 9/2004 | Hillis et al. | |
| 2004/0204155 | A1 | 10/2004 | Nassimi | |
| 2004/0207597 | A1 | 10/2004 | Marks | |
| 2004/0208497 | A1 | 10/2004 | Seger et al. | |
| 2004/0213419 | A1 | 10/2004 | Varma et al. | |
| 2004/0239670 | A1 | 12/2004 | Marks | |
| 2004/0240542 | A1 | 12/2004 | Yeredor et al. | |
| 2004/0255321 | A1 | 12/2004 | Matz | |
| 2005/0047611 | A1 | 3/2005 | Mao | |
| 2005/0059488 | A1 | 3/2005 | Larsen | |
| 2005/0077470 | A1 | 4/2005 | Tichit et al. | |
| 2005/0114126 | A1 | 5/2005 | Geiger et al. | |
| 2005/0115383 | A1 | 6/2005 | Chang | |
| 2005/0126369 | A1 | 6/2005 | Kirkeby et al. | |
| 2005/0162384 | A1 | 7/2005 | Yokoyama | |
| 2005/0174324 | A1 | 8/2005 | Liberty et al. | |
| 2005/0226431 | A1 | 10/2005 | Mao | |
| 2005/0282603 | A1 | 12/2005 | Parrot et al. | |
| 2006/0013416 | A1 * | 1/2006 | Truong et al. | 381/119 |
| 2006/0035710 | A1 | 2/2006 | Festejo et al. | |
| 2006/0115103 | A1 | 6/2006 | Feng et al. | |
| 2006/0121681 | A1 | 6/2006 | Nandakumar | |
| 2006/0136213 | A1 | 6/2006 | Hirose et al. | |

| | | | |
|---|---|---|---|
| 2006/0139322 | A1 | 6/2006 | Marks |
| 2006/0204012 | A1 | 9/2006 | Marks |
| 2006/0233389 | A1 | 10/2006 | Mao |
| 2006/0239471 | A1 | 10/2006 | Mao |
| 2006/0246407 | A1 | 11/2006 | Kang et al. |
| 2006/0252474 | A1 | 11/2006 | Zalewski |
| 2006/0252475 | A1 | 11/2006 | Zalewski |
| 2006/0252477 | A1 | 11/2006 | Zalewski |
| 2006/0252541 | A1 | 11/2006 | Zalewski |
| 2006/0252543 | A1 | 11/2006 | Van Noland et al. |
| 2006/0256081 | A1 | 11/2006 | Zalewski |
| 2006/0264258 | A1 | 11/2006 | Zalewski |
| 2006/0264259 | A1 | 11/2006 | Zalewski |
| 2006/0264260 | A1 | 11/2006 | Zalewski |
| 2006/0269072 | A1 | 11/2006 | Mao |
| 2006/0269073 | A1 | 11/2006 | Mao |
| 2006/0274032 | A1 | 12/2006 | Mao |
| 2006/0274911 | A1 | 12/2006 | Mao |
| 2006/0277571 | A1 | 12/2006 | Marks |
| 2006/0280312 | A1 | 12/2006 | Mao |
| 2006/0282873 | A1 | 12/2006 | Zalewski |
| 2006/0287084 | A1 | 12/2006 | Mao |
| 2006/0287085 | A1 | 12/2006 | Mao |
| 2006/0287086 | A1 | 12/2006 | Zalewski |
| 2006/0287087 | A1 | 12/2006 | Zalewski |
| 2007/0015558 | A1 | 1/2007 | Zalewski |
| 2007/0015559 | A1 | 1/2007 | Zalewski et al. |
| 2007/0021208 | A1 | 1/2007 | Mao |
| 2007/0025562 | A1 | 2/2007 | Zalewski et al. |
| 2007/0027687 | A1 | 2/2007 | Turk et al. |
| 2007/0060350 | A1 | 3/2007 | Osman |
| 2007/0061413 | A1 | 3/2007 | Larsen |
| 2007/0120834 | A1 | 5/2007 | Boillot |
| 2007/0120996 | A1 | 5/2007 | Boillot |
| 2007/0177743 | A1 | 8/2007 | Mertens |
| 2007/0213987 | A1 | 9/2007 | Turk et al. |
| 2007/0223732 | A1 | 9/2007 | Mao |
| 2007/0233489 | A1 | 10/2007 | Hirose et al. |
| 2007/0258599 | A1 | 11/2007 | Mao |
| 2007/0260340 | A1 | 11/2007 | Mao |
| 2007/0260517 | A1 | 11/2007 | Zalewski |
| 2007/0261077 | A1 | 11/2007 | Zalewski |
| 2007/0265075 | A1 | 11/2007 | Zalewski |
| 2007/0274535 | A1 | 11/2007 | Mao |
| 2007/0298882 | A1 | 12/2007 | Marks et al. |
| 2008/0001714 | A1 | 1/2008 | Ono et al. |
| 2008/0013745 | A1 | 1/2008 | Chen |
| 2008/0056561 | A1 | 3/2008 | Sawachi |
| 2008/0070684 | A1 | 3/2008 | Haigh-Hutchinson |
| 2008/0096654 | A1 | 4/2008 | Mondesir et al. |
| 2008/0096657 | A1 | 4/2008 | Benoist |
| 2008/0098448 | A1 | 4/2008 | Mondesir et al. |
| 2008/0100825 | A1 | 5/2008 | Zalewski |
| 2008/0101638 | A1 | 5/2008 | Ziller |
| 2008/0120115 | A1 | 5/2008 | Mao |
| 2009/0062943 | A1 | 3/2009 | Nason |

FOREIGN PATENT DOCUMENTS

| | | | |
|---|---|---|---|
| EP | 0867798 | A2 | 3/1998 |
| EP | 0869458 | B1 | 4/1998 |
| EP | 0750202 | B1 | 5/1998 |
| EP | 0613294 | A1 | 10/1998 |
| EP | 1033882 | A1 | 9/2000 |
| EP | 1074934 | A2 | 2/2001 |
| EP | 1180384 | A2 | 8/2001 |
| EP | 0652686 | B1 | 8/2002 |
| EP | 1411461 | A1 | 10/2002 |
| EP | 1279425 | A2 | 1/2003 |
| EP | 1358918 | A2 | 4/2003 |
| EP | 1335338 | A2 | 8/2003 |
| EP | 0835676 | B1 | 10/2004 |
| EP | 0823683 | B1 | 7/2005 |
| EP | 1489596 | B1 | 9/2006 |
| EP | 1449358 | B1 | 2/2011 |
| FR | 2780176 | B1 | 6/1998 |
| FR | 2832892 | B1 | 11/2001 |
| GB | 2376397 | A | 6/2001 |
| JP | 03288898 | A | 12/1991 |
| WO | 88/05942 | A1 | 8/1988 |
| WO | 99/26198 | A2 | 5/1999 |
| WO | 01/18563 | A1 | 9/1999 |
| WO | 2004/073814 | A1 | 9/2004 |
| WO | 2004/073815 | A1 | 9/2004 |
| WO | 2006/121896 | A2 | 11/2006 |
| WO | WO 2006/121681 | | 11/2006 |

OTHER PUBLICATIONS

USPTO; Advisory Action issued in U.S. Appl. No. 11/418,989; mailed Jun. 4, 2009; 3 pages.
USPTO; Office Action issued in U.S. Appl. No. 11/418,989; mailed Jun. 12, 2009; 8 pages.
USPTO; Office Action issued in U.S. Appl. No. 11/600,938; mailed Nov. 5, 2009; 17 pages.
USPTO; Final Office Action issued in U.S. Appl. No. 11/418,988; mailed Feb. 23, 2009; 5 pages.
USPTO; Final Office Action issued in U.S. Appl. No. 11/418,989; mailed Jan. 27, 2009; 8 pages.
USPTO; Office Action issued in U.S. Appl. No. 11/717,269; mailed Feb. 10, 2009; 8 pages.
USPTO; Final Office Action issued in U.S. Appl. No. 11/717,269; mailed Aug. 19, 2009; 9 pages.
USPTO; Final Office Action issued in U.S. Appl. No. 11/418,988; mailed Mar. 23, 2010; 7 pages.
USPTO; Office Action issued in U.S. Appl. No. 11/418,989; mailed Jan. 5, 2010; 9 pages.
USPTO; Final Office Action issued in U.S. Appl. No. 11/600,938; mailed Apr. 26, 2010; 17 pages.
USPTO; Final Office Action issued in U.S. Appl. No. 11/717,269; mailed Mar. 4, 2010; 9 pages.
USPTO; Advisory Action issued in U.S. Appl. No. 11/381,729; mailed Dec. 1, 2009; 2 pages.
USPTO; Notice of Allowance issued in U.S. Appl. No. 11/381,725; mailed Apr. 2, 2010; 8 pages.
Definition of "mount"—Merriam-Webster Online Dictionary.
CFS and FS95/98/2000: How to Use the Trim Controls to Keep Your Aircraft Level.
European Patent Office; "European Search Report" issued in European App. No. 07251651.1; dated Oct. 18, 2007; 16 pages.
Klinker, et al., "Distribute User Tracking Concepts for Augmented Reality Applications", p. 37-44, Oct. 2000.
Iddan, et al., "3D Imaging in the Studio (And Elsewhere)", p. 48-55, Jan. 24, 2001.
Jojie, et al., "Tracking Self-Occluding Articulated Objects in Dense Disparity Maps", p. 123-130, Oct. 1999.
"The Tracking Cube: A Three Dimensional Input Device", p. 91-95, Aug. 1, 1989.
Lanier, "Virtually There", 2003.
International Searching Authority; ISR and WO for PCT/US06/61056; mailed Mar. 3, 2008; 8 pages.
International Searching Authority; ISR and WO for PCT/US07/67004; mailed Jul. 28, 2008; 6 pages.
USPTO; Office Action issued in U.S. Appl. No. 11/382,035; mailed on Jul. 25, 2008; 12 pages.
USPTO; Office Action issued in U.S. Appl. No. 11/382,252, mailed on Aug. 8, 2007; 9 pages.
USPTO; Final Office Action issued in U.S. Appl. No. 11/382,252, mailed Jan. 17, 2008; 8 pages.
International Searching Authority; ISR and WO for PCT/US07/67010, mailed Oct. 3, 2008; 11 pages.
International Searching Authority; ISR and WO for PCT/US07/67005, mailed Jun. 18, 2008; 7 pages.
International Searching Authority; ISR and WO for PCT/US07/67324, mailed Oct. 3, 2008; 7 pages.
International Searching Authority; ISR and WO for PCT/US07/67961, mailed Sep. 16, 2008; 9 pages.
International Searching Authority; ISR and WO for PCT/US07/67437, mailed Jun. 3, 2008; 3 pages.
International Searching Authority; ISR and WO for PCT/US07/67697, mailed Sep. 15, 2008; 4 pages.
USPTO; Office Action issued in U.S. Appl. No. 11/382,250, mailed Jul. 22, 2008; 11 pages.

USPTO; Office Action issued in U.S. Appl. No. 11/382,252, mailed May 13, 2008; 9 pages.
USPTO; Final Office Action issued in U.S. Appl. No. 11/382,252, mailed Nov. 26, 2008; 12 pages.
USPTO; Final Office Action issued in U.S. Appl. No. 11/382,035, mailed Jan. 7, 2009; 15 pages.
USPTO; Final Office Action issued in U.S. Appl. No. 11/382,035, Dec. 28, 2009; 18 pages.
USPTO; Office Action issued in U.S. Appl. No. 11/382,035, mailed May 27, 2009; 15 pages.
USPTO; Office Action issued in U.S. Appl. No. 11/382,035, mailed Mar. 30, 2010; 21 pages.
USPTO; Office Action issued in U.S. Appl. No. 11/381,721; mailed on Mar. 26, 2010; 21 pages.
USPTO; Office Action issued in U.S. Appl. No. 11/381,729, mailed Sep. 29, 2008; 15 pages.
USPTO; Notice of Allowance issued in U.S. Appl. No. 11/381,724, mailed Feb. 5, 2010; 8 pages.
USPTO; Office Action issued in U.S. Appl. No. 11/381,725, mailed Feb. 18, 2009; 13 pages.
USPTO; Office Action issued in U.S. Appl. No. 11/381,729, mailed Mar. 13, 2009; 14 pages.
USPTO; Final Office Action issued in U.S. Appl. No. 11/381,729, mailed Sep. 17, 2009; 13 pages.
USPTO; Office Action issued in U.S. Appl. No. 11/381,725, mailed Aug. 19, 2008; 15 pages.
USPTO; Notice of Allowance issued in U.S. Appl. No. 11/381,725, mailed Dec. 18, 2009; 8 pages.
USPTO; Notice of Allowance issued in U.S. Appl. No. 11/381,729; mailed Jan. 19, 2010; 8 pages.
USPTO; Final Office Action issued in U.S. Appl. No. 11/381,725, mailed Aug. 20, 2009; 12 pages.
USPTO; Office Action issued in U.S. Appl. No. 11/381,724, mailed Aug. 20, 2008; 21 pages.
USPTO; Office Action issued in U.S. Appl. No. 11/381,724; mailed Feb. 24, 2009; 15 pages.
USPTO; Office Action issued in U.S. Appl. No. 11/381,724; mailed Aug. 19, 2009; 17 pages.
USPTO; Office Action issued in U.S. Appl. No. 11/382,256; mailed Sep. 25, 2009; 7 pages.
Benesty, "Adaptive Eigenvalue Decomposition Algorithm for Passive Acoustic Source Localization", p. 384-391, Jan. 2000.
Ephraim and Malah, "Speech Enhancement Using a Minimum Mean-Square Error Short-Time Spectral Amplitude Estimator", p. 1109-1121.
Ephraim and Malah, "Speech Enhancement Using a Minimum Mean-Square Error Log-Spectral Amplitude Estimator", p. 443-445, Apr. 1985.
Fiala, et al., "A Panoramic Video and Acoustic Beamforming Sensor for Videoconferencing", p. 47-52, Oct. 2, 2004.
Wilson, et al., "Audio-Video Array Source Localization for Intelligent Environments", p. 2109-2112, 2002.
USPTO; Notice of Allowance issued in U.S. Appl. No. 11/418,988; mailed Jul. 12, 2010; 6 pages.
USPTO; Notice of Allowance issued in U.S. Appl. No. 11/418,989; mailed Jul. 9, 2010; 7 pages.
USPTO; Interview Summary issued in U.S. Appl. No. 11/418,989; mailed Apr. 9, 2010; 3 pages.
USPTO; Interview Summary issued in U.S. Appl. No. 11/717,269; mailed Jun. 9, 2010; 3 pages.
USPTO; Final Office Action issued in U.S. Appl. No. 11/717,269; mailed Jun. 29, 2010; 10 pages.
USPTO; Notice of Allowance issued in U.S. Appl. No. 11/381,729; mailed Jan. 19, 2010; 6 pages.
USPTO Notice of Allowance issued in U.S. Appl. No. 11/381,729; mailed May 27, 2010; 4 pages.
USPTO; Notice of Allowance issued in U.S. Appl. No. 11/381,729; mailed Jul. 16, 2010; 2 pages.
USPTO; Interview Summary issued in U.S. Appl. No. 11/381,729; mailed Nov. 27, 2009; 3 pages.
USPTO; Notice of Allowance issued in U.S. Appl. No. 11/382,256; mailed May 19, 2010; 8 pages.
USPTO; Interview Summary issued in U.S. Appl. No. 11/382,256; mailed May 19, 2010; 2 pages.
USPTO; Interview Summary issued in U.S. Appl. No. 11/381,725; mailed Dec. 1, 2009; 3 pages.
USPTO; Interview Summary issued in U.S. Appl. No. 11/418,989; mailed Apr. 15, 2009; 2 pages.
USPTO; Notice of Allowance issued in U.S. Appl. No. 11/418,989; mailed Sep. 30, 2010; 6 pages.
USPTO; Interview Summary issued in U.S. Appl. No. 11/717,269; mailed Sep. 14, 2010; 3 pages.
USPTO; Advisory Action issued in U.S. Appl. No. 11/717,269; mailed Oct. 13, 2010; 3 pages.
USPTO; Final Office Action issued in U.S. Appl. No. 11/381,721; mailed Sep. 13, 2010; 23 pages.
USPTO; Advisory Action issued in U.S. Appl. No. 11/381,721; mailed Nov. 29, 2010; 3 pages.
USPTO; Notice of Allowance issued in U.S. Appl. No. 11/381,725; mailed Jul. 26, 2010; 5 pages.
USPTO; Notice of Allowance issued in U.S. Appl. No. 11/418,988; mailed Dec. 16, 2010; 6 pages.
USPTO; Notice of Allowance issued in U.S. Appl. No. 11/418,989; mailed Mar. 3, 2011; 8 pages.
USPTO; Office Action issued in U.S. Appl. No. 11/717,269; mailed Feb. 24, 2011; 9 pages.
USPTO; Office Action issued in U.S. Appl. No. 11/895,723; mailed Feb. 8, 2011; 12 pages.
Nilsson et al.; ID3v2 Draft Specification; published at http://www.id3.org/id3v2-00?action=print; copyright Mar. 26, 1998; 40 pages; Sweden.
USPTO; Notice of Allowance issued in U.S. Patent Application No. 11/418,989; mailed Jul. 18, 2011; 9 pages.
USPTO; Final Office Action issued in U.S. Appl. No. 11/429,047; mailed Aug. 3, 2011; 11 pages.
USPTO; Final Office Action issued in U.S. Appl. No. 11/717,269; mailed Aug. 31, 2011; 10 pages.
USPTO; Office Action issued in U.S. Appl. No. 11/418,988; mailed Mar. 7, 2011; 6 pages.
USPTO; Notice of Allowance issued in U.S. Appl. No. 11/418,988; mailed Aug. 5, 2011; 7 pages.
USPTO; Final Office Action issued in U.S. Appl. No. 11/895,723; mailed May 31, 2011; 16 pages.
USPTO; Final Office Action issued in U.S. Appl. No. 11/381,721; mailed Jun. 28, 2011; 23 pages.
USPTO; Office Action issued in U.S. Appl. No. 11/381,724; mailed Dec. 23, 2010; 8 pages.
USPTO; Notice of Allowance issued in U.S. Appl. No. 11/381,724; mailed May 27, 2011; 9 pages.
USPTO; Notice of Allowance issued in U.S. Appl. No. 11/381,724; mailed Sep. 19, 2011; 8 pages.
USPTO; Final Office Action issued in U.S. Appl. No. 11/381,721; mailed Jan. 19, 2011; 22 pages.
UPSTO, Final Office Action issued in U.S. Appl. No. 11/418,988 mailed Mar. 7, 2011, 6 pages.
UPSTO, Notice of Allowance issued in U.S. Appl. No. 11/418,988 mailed Aug. 5, 2011, 7 pages.
UPSTO, Notice of Allowance issued in U.S. Appl. No. 11/418,988 mailed Dec. 13, 2011, 7 pages.
USPTO, Notice of Allowance issued in U.S. Appl. No. 11/418,989 mailed Jul. 18, 2011, 9 pages.
USPTO, Notice of Allowance issued in U.S. Appl. No. 11/418,989 mailed Nov. 15, 2011 pages.
U.S. Appl. No. 11/624,637, filed Jan. 18, 2007, Harrison.
U.S. Appl. No. 29/259,348, filed May 6, 2006, Zalewski.
U.S. Appl. No. 29/259,349, filed May 6, 2006, Goto.
U.S. Appl. No. 29/259,350, filed May 6, 2006, Zalewski.
U.S. Appl. No. 60/798,031, filed May 6, 2006, Woodard.
U.S. Appl. No. 60/718,145, filed Sep. 15, 2005, Hernandez-Abrego.
U.S. Appl. No. 60/678,413, filed May 5, 2005, Marks.
U.S. Appl. No. 29/246,743, filed May 8, 2006.
U.S. Appl. No. 29/246,744, filed May 8, 2006.
U.S. Appl. No. 29/246,759, filed May 8, 2006.
U.S. Appl. No. 29/246,762, filed May 8, 2006.
U.S. Appl. No. 29/246,763, filed May 8, 2006.

U.S. Appl. No. 29/246,764, filed May 8, 2006.
U.S. Appl. No. 29/246,765, filed May 8, 2006.
U.S. Appl. No. 29/246,766, filed May 8, 2006.
U.S. Appl. No. 29/246,767, filed May 8, 2006.
U.S. Appl. No. 29/246,768, filed May 8, 2006.
U.S. Appl. No. 11/895,723, filed Aug. 27, 2007. Nason.
Patent Cooperation Treaty: "International Search Report" for PCT Application No. PCT/US2006/016670, which corresponds to U.S. Pub. No. 2006-0204012; mailed Aug. 30, 2006; 2 pages.
Patent Cooperation Treaty: "Written Opinion of the International Searching Authority" for PCT Application No. PCT/US2006/016670, which corresponds to U.S. Pub. No. 2006-0204012; mailed Aug. 30, 2006; 4 pages.
USPTO, Issue Notification issued in U.S. Appl. No. 11/418,989 mailed Feb. 29, 2012, 1 page [92110].

* cited by examiner

METHODS AND APPARATUSES FOR CAPTURING AN AUDIO SIGNAL BASED ON A LOCATION OF THE SIGNAL

CROSS-REFERENCE TO RELATED APPLICATIONS

This Application claims the benefit of priority of U.S. Provisional Patent Application No. 60/678,413, filed May 5, 2005, the entire disclosures of which are incorporated herein by reference. This Application claims the benefit of priority of U.S. Provisional Patent Application No. 60/718,145, filed Sep. 15, 2005, the entire disclosures of which are incorporated herein by reference. This application is a continuation-in-part of and claims the benefit of priority of U.S. patent application Ser. No. 10/650,409, filed Aug. 27, 2003 now U.S. Pat. No. 7,613,310 and published on Mar. 3, 2005 as US Patent Application Publication No. 2005/0047611, the entire disclosures of which are incorporated herein by reference. This application is a continuation-in-part of and claims the benefit of priority of commonly-assigned U.S. patent application Ser. No. 10/820,469, which was filed Apr. 7, 2004 now U.S. Pat. No. 7,970,147 and published on Oct. 13, 2005 as US Patent Application Publication 20050226431, the entire disclosures of which are incorporated herein by reference.

This application is related to commonly-assigned, co-pending application Ser. No. 11/381,729, to Xiao Dong Mao, entitled "ULTRA SMALL MICROPHONE ARRAY", published as U.S. Publication No. 2007/0260340, filed the same day as the present application, the entire disclosures of which are incorporated herein by reference. This application is also related to commonly-assigned, co-pending application Ser. No. 11/381,728, to Xiao Dong Mao, entitled "ECHO AND NOISE CANCELLATION", published as U.S. Publication No. 2007/0274535, filed the same day as the present application, the entire disclosures of which are incorporated herein by reference. This application is also related to commonly-assigned, co-pending application Ser. No. 11/381,725, to Xiao Dong Mao, entitled "METHODS AND APPARATUS FOR TARGETED SOUND DETECTION", published as U.S. Publication No. 2007/0255562, filed the same day as the present application, the entire disclosures of which are incorporated herein by reference. This application is also related to commonly-assigned, co-pending application Ser. No. 11/381,727, to Xiao Dong Mao, entitled "NOISE REMOVAL FOR ELECTRONIC DEVICE WITH FAR FIELD MICROPHONE ON CONSOLE", published as U.S. Publication No. 2007/0258599, filed the same day as the present application, the entire disclosures of which are incorporated herein by reference. This application is also related to commonly-assigned, co-pending application Ser. No. 11/381,724, to Xiao Dong Mao, entitled "METHODS AND APPARATUS FOR TARGETED SOUND DETECTION AND CHARACTERIZATION", published as U.S. Publication No. 2007/0233389, filed the same day as the present application, the entire disclosures of which are incorporated herein by reference. This application is also related to commonly-assigned, co-pending application Ser. No. 11/381,721, to Xiao Dong Mao, entitled "SELECTIVE SOUND SOURCE LISTENING IN CONJUNCTION WITH COMPUTER INTERACTIVE PROCESSING", published as U.S. Publication No. 2006/0239471, filed the same day as the present application, the entire disclosures of which are incorporated herein by reference. This application is also related to commonly-assigned, co-pending International Patent Application number PCT/2006/017483, to Xiao Dong Mao, entitled "SELECTIVE SOUND SOURCE LISTENING IN CONJUNCTION WITH COMPUTER INTERACTIVE PROCESSING", published as International Publication No. WO2006/121896, filed the same day as the present application, the entire disclosures of which are incorporated herein by reference. This application is also related to commonly-assigned, co-pending application Ser. No. 11/418,988, to Xiao Dong Mao, entitled "METHODS AND APPARATUSES FOR ADJUSTING A LISTENING AREA FOR CAPTURING SOUNDS", published as U.S. Publication No. 2006/0269072 filed the same day as the present application, the entire disclosures of which are incorporated herein by reference. This application is also related to commonly-assigned, co-pending application Ser. No. 11/418,989, to Xiao Dong Mao, entitled "METHODS AND APPARATUSES FOR CAPTURING AN AUDIO SIGNAL BASED ON A LOCATION OF THE SIGNAL", published as U.S. Publication No. 2006/0280312, filed the same day as the present application, the entire disclosures of which are incorporated herein by reference. This application is related to commonly-assigned U.S. patent application Ser. No. 11/429,414, to Richard L. Marks et al., entitled "COMPUTER IMAGE AND AUDIO PROCESSING OF INTENSITY AND INPUT DEVICES FOR INTERFACING WITH A COMPUTER PROGRAM", published as U.S. Publication No. 2006/0277571, filed the same day as the present application, the entire disclosures of which are incorporated herein by reference. This application is related to commonly-assigned, U.S. patent application Ser. No. 10/759,782 to Richard L. Marks, filed Jan. 16, 2004 and entitled "METHOD AND APPARATUS FOR LIGHT INPUT DEVICE" published as U.S. Publication No. 2004/0207597, which is incorporated herein by reference.

FIELD OF THE INVENTION

The present invention relates generally to capturing an audio signal and, more particularly, to capturing an audio signal based on a location of the signal.

BACKGROUND

With the increased use of electronic devices and services, there has been a proliferation of applications that utilize listening devices to detect sound. A microphone is typically utilized as a listening device to detect sounds for use in conjunction with these applications that are utilized by electronic devices and services. Further, these listening devices are typically configured to detect sounds from a fixed area. Often times, unwanted background noises are also captured by these listening devices in addition to meaningful sounds. Unfortunately by capturing unwanted background noises along with the meaningful sounds, the resultant audio signal is often degraded and contains errors which make the resultant audio signal more difficult to use with the applications and associated electronic devices and services.

SUMMARY

In one embodiment, the methods and apparatuses detect an initial listening zone wherein the initial listening zone represents an initial area monitored for sounds; detect an initial sound within the initial listening zone; and adjust the initial listening zone and forming the adjusted listening zone having an adjusted area based wherein the initial sound emanates from within the adjusted listening zone.

BRIEF DESCRIPTION OF THE DRAWINGS

The accompanying drawings, which are incorporated in and constitute a part of this specification, illustrate and explain one embodiment of the methods and apparatuses for capturing an audio signal based on a location of the signal. In the drawings.

DETAILED DESCRIPTION

The following detailed description of the methods and apparatuses for capturing an audio signal based on a location of the signal refers to the accompanying drawings. The detailed description is not intended to limit the methods and apparatuses for capturing an audio signal based on a location of the signal. Instead, the scope of the methods and apparatuses for automatically selecting a profile is defined by the appended claims and equivalents. Those skilled in the art will recognize that many other implementations are possible, consistent with the methods and apparatuses for capturing an audio signal based on a location of the signal.

References to "electronic device" includes a device such as a personal digital video recorder, digital audio player, gaming console, a set top box, a computer, a cellular telephone, a personal digital assistant, a specialized computer such as an electronic interface with an automobile, and the like.

In one embodiment, the methods and apparatuses for capturing an audio signal based on a location of the signal are configured to identify different areas that encompass corresponding listening zones. A microphone array is configured to detect sounds originating from these areas corresponding to these listening zones. Further, these areas may be a smaller subset of areas that are capable of being monitored for sound by the microphone array. In one embodiment, the area that is monitored for sound by the microphone array may be further focused to detect a sound in a particular location such that the area that is monitored is reduced from the initial area. Further, the level of the sound is compared against a threshold level to validate the sound. The sound source from the particular location is monitored for continuing sound. In one embodiment, by reducing from the initial area to the reduced area, unwanted background noises are minimized.

Figure 1:
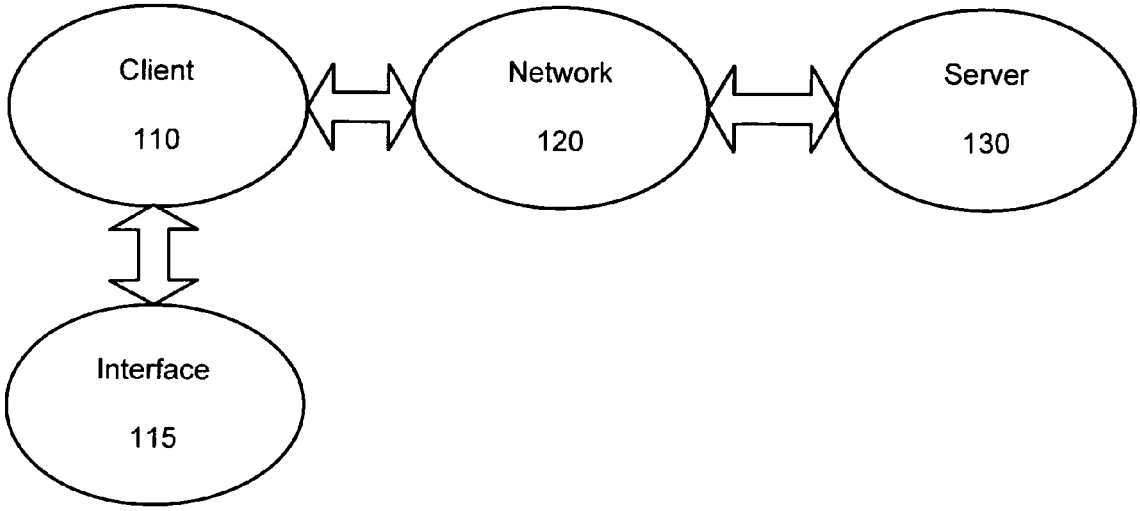
FIG. 1 is a diagram illustrating an environment within which the methods and apparatuses for capturing an audio signal based on a location of the signal are implemented.

FIG. 1 is a diagram illustrating an environment within which the methods and apparatuses for capturing an audio signal based on a location of the signal are implemented. The environment includes an electronic device 110 (e.g., a computing platform configured to act as a client device, such as a personal digital video recorder, digital audio player, computer, a personal digital assistant, a cellular telephone, a camera device, a set top box, a gaming console), a user interface 115, a network 120 (e.g., a local area network, a home network, the Internet), and a server 130 (e.g., a computing platform configured to act as a server). In one embodiment, the network 120 can be implemented via wireless or wired solutions.

In one embodiment, one or more user interface 115 components are made integral with the electronic device 110 (e.g., keypad and video display screen input and output interfaces in the same housing as personal digital assistant electronics (e.g., as in a Clie® manufactured by Sony Corporation). In other embodiments, one or more user interface 115 components (e.g., a keyboard, a pointing device such as a mouse and trackball, a microphone, a speaker, a display, a camera) are physically separate from, and are conventionally coupled to, electronic device 110. The user utilizes interface 115 to access and control content and applications stored in electronic device 110, server 130, or a remote storage device (not shown) coupled via network 120.

In accordance with the invention, embodiments of capturing an audio signal based on a location of the signal as described below are executed by an electronic processor in electronic device 110, in server 130, or by processors in electronic device 110 and in server 130 acting together. Server 130 is illustrated in FIG. 1 as being a single computing platform, but in other instances are two or more interconnected computing platforms that act as a server.

The methods and apparatuses for capturing an audio signal based on a location of the signal are shown in the context of exemplary embodiments of applications in which the user profile is selected from a plurality of user profiles. In one embodiment, the user profile is accessed from an electronic device 110 and content associated with the user profile can be created, modified, and distributed to other electronic devices 110. In one embodiment, the content associated with the user profile includes a customized channel listing associated with television or musical programming and recording information associated with customized recording times.

In one embodiment, access to create or modify content associated with the particular user profile is restricted to authorized users. In one embodiment, authorized users are based on a peripheral device such as a portable memory device, a dongle, and the like. In one embodiment, each peripheral device is associated with a unique user identifier which, in turn, is associated with a user profile.

Figure 2:
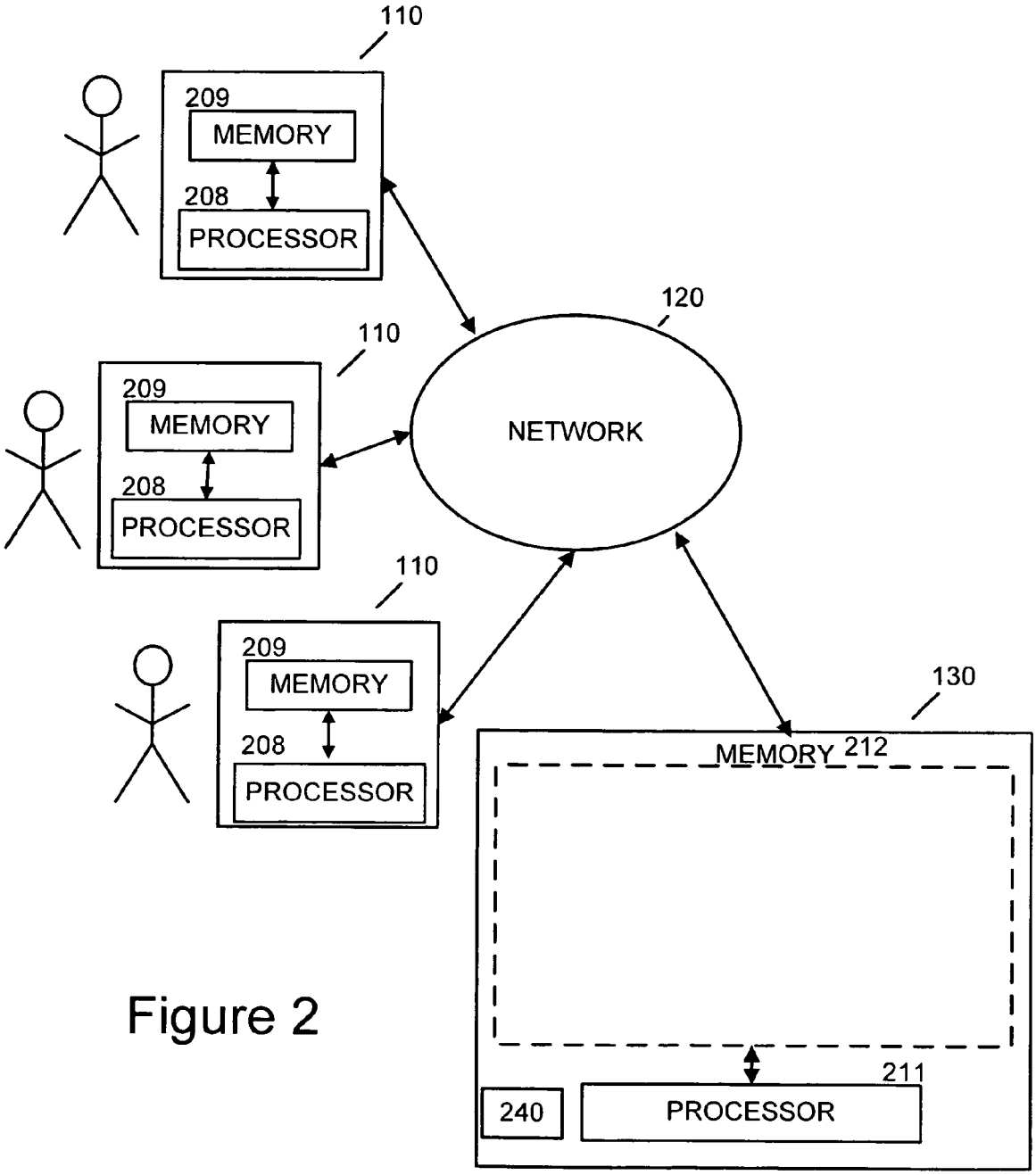
FIG. 2 is a simplified block diagram illustrating one embodiment in which the methods and apparatuses for capturing an audio signal based on a location of the signal are implemented.

FIG. 2 is a simplified diagram illustrating an exemplary architecture in which the methods and apparatuses for capturing an audio signal based on a location of the signal are implemented. The exemplary architecture includes a plurality of electronic devices 110, a server device 130, and a network 120 connecting electronic devices 110 to server 130 and each electronic device 110 to each other. The plurality of electronic devices 110 are each configured to include a computer-readable medium 209, such as random access memory, coupled to an electronic processor 208. Processor 208 executes program instructions stored in the computer-readable medium 209. A unique user operates each electronic device 110 via an interface 115 as described with reference to FIG. 1.

Server device 130 includes a processor 211 coupled to a computer-readable medium 212. In one embodiment, the server device 130 is coupled to one or more additional external or internal devices, such as, without limitation, a secondary data storage element, such as database 240.

In one instance, processors 208 and 211 are manufactured by Intel Corporation, of Santa Clara, Calif. In other instances, other microprocessors are used.

The plurality of client devices 110 and the server 130 include instructions for a customized application for capturing an audio signal based on a location of the signal. In one embodiment, the plurality of computer-readable medium 209 and 212 contain, in part, the customized application. Additionally, the plurality of client devices 110 and the server 130 are configured to receive and transmit electronic messages for use with the customized application. Similarly, the network 120 is configured to transmit electronic messages for use with the customized application.

One or more user applications are stored in memories 209, in memory 211, or a single user application is stored in part in one memory 209 and in part in memory 211. In one instance, a stored user application, regardless of storage location, is made customizable based on capturing an audio signal based on a location of the signal as determined using embodiments described below.

Figure 3A:
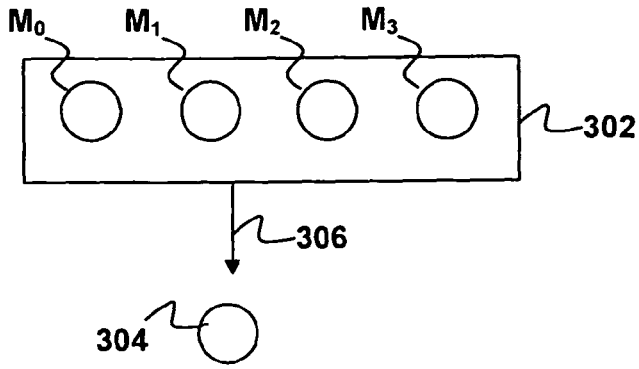
FIG. 3A is a schematic diagram illustrating a microphone array and a listening direction in which the methods and apparatuses for capturing an audio signal based on a location of the signal are implemented.

As depicted in FIG. 3A, a microphone array 302 may include four microphones $M_0$, $M_1$, $M_2$, and $M_3$. In general, the microphones $M_0$, $M_1$, $M_2$, and $M_3$ may be omni-directional microphones, i.e., microphones that can detect sound from essentially any direction. Omni-directional microphones are generally simpler in construction and less expensive than microphones having a preferred listening direction. An audio signal arriving at the microphone array 302 from one or more sources 304 may be expressed as a vector $x=[x_0, x_1, x_2, x_3]$, where $x_0$, $x_1$, $x_2$ and $x_3$ are the signals received by the microphones $M_0$, $M_1$, $M_2$ and $M_3$ respectively. Each signal $x_m$ generally includes subcomponents due to different sources of sounds. The subscript m range from 0 to 3 in this example and is used to distinguish among the different microphones in the array. The subcomponents may be expressed as a vector $s=[s_1, s_2, \ldots s_K]$, where K is the number of different sources. To separate out sounds from the signal s originating from different sources one must determine the best filter time delay of arrival (TDA) filter. For precise TDA detection, a state-of-art yet computationally intensive Blind Source Separation (BSS) is preferred theoretically. Blind source separation separates a set of signals into a set of other signals, such that the regularity of each resulting signal is maximized, and the regularity between the signals is minimized (i.e., statistical independence is maximized or decorrelation is minimized).

The blind source separation may involve an independent component analysis (ICA) that is based on second-order statistics. In such a case, the data for the signal arriving at each microphone may be represented by the random vector $x_m=[x_1 \ldots x_n]$ and the components as a random vector $s=[s_1, \ldots s_n]$. The task is to transform the observed data $x_m$, using a linear static transformation $s=Wx$, into maximally independent components s measured by some function $F(s_{-1}, \ldots s_n)$ of independence.

The components $x_{mi}$ of the observed random vector $x_m=(x_{m1}, \ldots, x_{mn})$ are generated as a sum of the independent components $s_{mk}$, $k=1, \ldots, n$, $x_{mi}=a_{mi1}s_{m1}+ \ldots +a_{mik}s_{mk}+ \ldots +a_{min}s_{mn}$, weighted by the mixing weights $a_{mik}$. In other words, the data vector $x_m$ can be written as the product of a mixing matrix A with the source vector $s^T$, i.e., $x_m=A \cdot s^T$ or $$\begin{bmatrix} x_{m1} \\ \vdots \\ x_{mn} \end{bmatrix} = \begin{bmatrix} a_{m11} & \cdots & a_{m1n} \\ \vdots & \cdots & \vdots \\ a_{mn1} & \cdots & a_{mnn} \end{bmatrix} \cdot \begin{bmatrix} s_1 \\ \vdots \\ s_n \end{bmatrix}$$

The original sources s can be recovered by multiplying the observed signal vector $x_m$ with the inverse of the mixing matrix $W=A^{-1}$, also known as the unmixing matrix. Determination of the unmixing matrix $A^{-1}$ may be computationally intensive. Some embodiments of the invention use blind source separation (BSS) to determine a listening direction for the microphone array. The listening direction of the microphone array can be calibrated prior to run time (e.g., during design and/or manufacture of the microphone array) and recalibrated at run time.

By way of example, the listening direction may be determined as follows. A user standing in a listening direction with respect to the microphone array may record speech for about 10 to 30 seconds. The recording room should not contain transient interferences, such as competing speech, background music, etc. Pre-determined intervals, e.g., about every 8 milliseconds, of the recorded voice signal are formed into analysis frames, and transformed from the time domain into the frequency domain. Voice-Activity Detection (VAD) may be performed over each frequency-bin component in this frame. Only bins that contain strong voice signals are collected in each frame and used to estimate its $2^{nd}$-order statistics, for each frequency bin within the frame, i.e. a "Calibration Covariance Matrix" $Cal_Cov(j,k)=E((X'_{jk})^T*X'_{jk})$, where E refers to the operation of determining the expectation value and $(X'_{jk})^T$ is the transpose of the vector $X'_{jk}$. The vector $X'_{jk}$ is a M+1 dimensional vector representing the Fourier transform of calibration signals for the $j^{th}$ frame and the $k^{th}$ frequency bin.

The accumulated covariance matrix then contains the strongest signal correlation that is emitted from the target listening direction. Each calibration covariance matrix Cal_Cov(j,k) may be decomposed by means of "Principal Component Analysis" (PCA) and its corresponding eigenmatrix C may be generated. The inverse $C^{-1}$ of the eigenmatrix C may thus be regarded as a "listening direction" that essentially contains the most information to de-correlate the covariance matrix, and is saved as a calibration result. As used herein, the term "eigenmatrix" of the calibration covariance matrix Cal_Cov(j,k) refers to a matrix having columns (or rows) that are the eigenvectors of the covariance matrix.

At run time, this inverse eigenmatrix $C^{-1}$ may be used to de-correlate the mixing matrix A by a simple linear transformation. After de-correlation, A is well approximated by its diagonal principal vector, thus the computation of the unmixing matrix (i.e., $A^{-1}$) is reduced to computing a linear vector inverse of:

$$A1=A*C^{-1}$$

A1 is the new transformed mixing matrix in independent component analysis (ICA). The principal vector is just the diagonal of the matrix A1.

Recalibration in runtime may follow the preceding steps. However, the default calibration in manufacture takes a very large amount of recording data (e.g., tens of hours of clean voices from hundreds of persons) to ensure an unbiased, person-independent statistical estimation. While the recalibration at runtime requires small amount of recording data from a particular person, the resulting estimation of $C^{-1}$ is thus biased and person-dependant.

As described above, a principal component analysis (PCA) may be used to determine eigenvalues that diagonalize the mixing matrix A. The prior knowledge of the listening direction allows the energy of the mixing matrix A to be compressed to its diagonal. This procedure, referred to herein as semi-blind source separation (SBSS) greatly simplifies the calculation the independent component vector $s^T$.

Figure 3B:
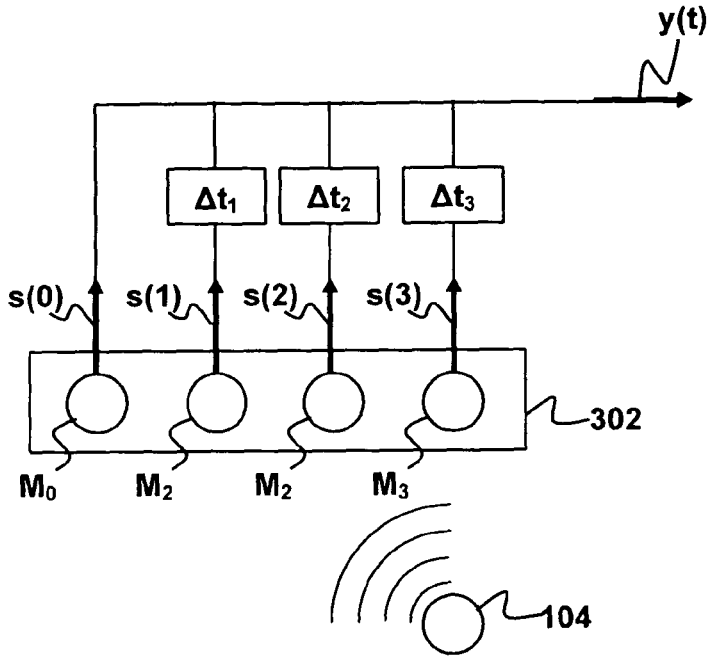
FIG. 3B is a schematic diagram of a microphone array illustrating anti-causal filtering in which the methods and apparatuses for capturing an audio signal based on a location of the signal are implemented.

Embodiments of the invention may also make use of anti-causal filtering. The problem of causality is illustrated in FIG. 3B. In the microphone array 302 one microphone, e.g., $M_0$ is chosen as a reference microphone. In order for the signal x(t) from the microphone array to be causal, signals from the source 304 must arrive at the reference microphone $M_0$ first. However, if the signal arrives at any of the other microphones first, $M_0$ cannot be used as a reference microphone. Generally, the signal will arrive first at the microphone closest to the source 304. Embodiments of the present invention adjust for variations in the position of the source 304 by switching the reference microphone among the microphones $M_0$, $M_1$, $M_2$, $M_3$ in the array 302 so that the reference microphone always receives the signal first. Specifically, this anti-causality may be accomplished by artificially delaying the signals received at all the microphones in the array except for the reference microphone while minimizing the length of the delay filter used to accomplish this.

For example, if microphone $M_0$ is the reference microphone, the signals at the other three (non-reference) microphones $M_1$, $M_2$, $M_3$ may be adjusted by a fractional delay $\Delta t_m$, (m=1, 2, 3) based on the system output y(t). The fractional delay $\Delta t_m$ may be adjusted based on a change in the signal to noise ratio (SNR) of the system output y(t). Generally, the delay is chosen in a way that maximizes SNR. For example, in the case of a discrete time signal the delay for the signal from each non-reference microphone $\Delta t_m$ at time sample t may be calculated according to: $\Delta t_m(t)=\Delta t_m(t-1)+\mu\Delta SNR$, where ΔSNR is the change in SNR between t−2 and t−1 and μ is a pre-defined step size, which may be empirically determined. If Δt(t)>1 the delay has been increased by 1 sample. In embodiments of the invention using such delays for anti-causality, the total delay (i.e., the sum of the $\Delta t_m$) is typically 2-3 integer samples. This may be accomplished by use of 2-3 filter taps. This is a relatively small amount of delay when one considers that typical digital signal processors may use digital filters with up to 512 taps. It is noted that applying the artificial delays $\Delta t_m$ to the non-reference microphones is the digital equivalent of physically orienting the array 302 such that the reference microphone $M_0$ is closest to the sound source 304.

Figure 4A:
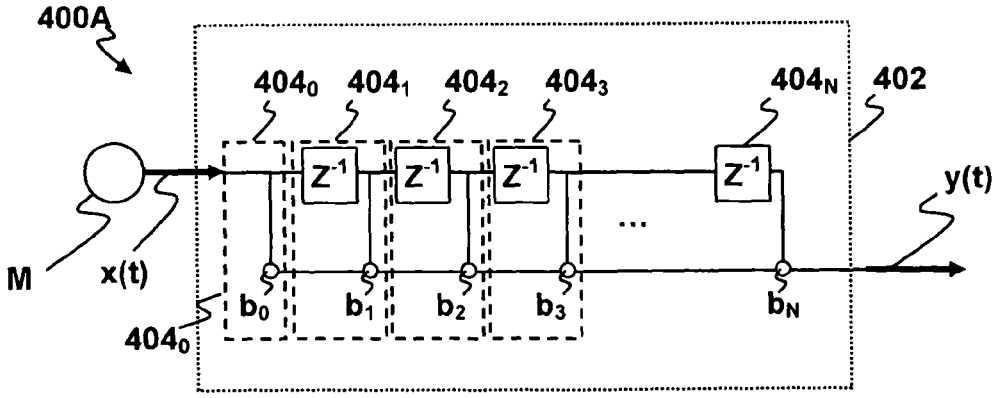
FIG. 4A is a schematic diagram of a microphone array and filter apparatus in which the methods and apparatuses for capturing an audio signal based on a location of the signal are implemented.

FIG. 4A illustrates filtering of a signal from one of the microphones $M_0$ in the array 302. In an apparatus 400A the signal from the microphone $x_0(t)$ is fed to a filter 402, which is made up of N+1 taps $\mathbf{404}_0 \ldots \mathbf{404}_N$. Except for the first tap $\mathbf{404}_0$ each tap $\mathbf{404}_i$ includes a delay section, represented by a z-transform $z^{-1}$ and a finite response filter. Each delay section introduces a unit integer delay to the signal x(t). The finite impulse response filters are represented by finite impulse response filter coefficients $b_0, b_1, b_2, b_3, \ldots b_N$. In embodiments of the invention, the filter 402 may be implemented in hardware or software or a combination of both hardware and software. An output y(t) from a given filter tap $\mathbf{404}_i$ is just the convolution of the input signal to filter tap $\mathbf{404}_i$ with the corresponding finite impulse response coefficient $b_i$. It is noted that for all filter taps $\mathbf{404}_i$ except for the first one $\mathbf{404}_0$ the input to the filter tap is just the output of the delay section $z^{-1}$ of the preceding filter tap $\mathbf{404}_{i-1}$. Thus, the output of the filter 402 may be represented by:

$$y(t)=x(t)*b_0+x(t-1)*b_1+x(t-2)*b_2+\ldots+X(t-N)_bN.$$

Where the symbol "*" represents the convolution operation. Convolution between two discrete time functions f(t) and g(t) is defined as $$(f*g)(t)=\sum_n f(n)g(t-n).$$

The general problem in audio signal processing is to select the values of the finite impulse response filter coefficients $b_0$, $b_1, \ldots, b_N$ that best separate out different sources of sound from the signal y(t).

If the signals x(t) and y(t) are discrete time signals each delay $z^{-1}$ is necessarily an integer delay and the size of the delay is inversely related to the maximum frequency of the microphone. This ordinarily limits the resolution of the system 400A. A higher than normal resolution may be obtained if it is possible to introduce a fractional time delay Δ into the signal y(t) so that:

$$y(t+\Delta)=x(t+\Delta)*b_0+x(t-1+\Delta)*b_1+x(t-2+\Delta)*b_2+\ldots+x(t-N+A)_bN,$$

where Δ is between zero and ±1. In embodiments of the present invention, a fractional delay, or its equivalent, may be obtained as follows. First, the signal x(t) is delayed by j samples. each of the finite impulse response filter coefficients $b_i$ (where i=0, 1, . . . N) may be represented as a (J+1)-dimensional column vector $$b_i = \begin{bmatrix} b_{i0} \\ b_{i1} \\ \vdots \\ b_{iJ} \end{bmatrix}$$

and y(t) may be rewritten as:

$$y(t) = \begin{bmatrix} x(t) \\ x(t-1) \\ \vdots \\ x(t-J) \end{bmatrix}^T * \begin{bmatrix} b_{00} \\ b_{01} \\ \vdots \\ b_{0j} \end{bmatrix} + \begin{bmatrix} x(t-1) \\ x(t-2) \\ \vdots \\ x(t-J-1) \end{bmatrix}^T * \begin{bmatrix} b_{10} \\ b_{11} \\ \vdots \\ b_{1J} \end{bmatrix} + \ldots + \begin{bmatrix} x(t-N-J) \\ x(t-N-J+1) \\ \vdots \\ x(t-N) \end{bmatrix}^T * \begin{bmatrix} b_{N0} \\ b_{N1} \\ \vdots \\ b_{NJ} \end{bmatrix}$$

When y(t) is represented in the form shown above one can interpolate the value of y(t) for any factional value of t=t+Δ. Specifically, three values of y(t) can be used in a polynomial interpolation. The expected statistical precision of the fractional value Δ is inversely proportional to J+1, which is the number of "rows" in the immediately preceding expression for y(t).

In embodiments of the invention, the quantity t+Δ may be regarded as a mathematical abstract to explain the idea in time-domain. In practice, one need not estimate the exact "t+Δ". Instead, the signal y(t) may be transformed into the frequency-domain, so there is no such explicit "t+Δ". Instead an estimation of a frequency-domain function $F(b_i)$ is sufficient to provide the equivalent of a fractional delay Δ. The above equation for the time domain output signal y(t) may be transformed from the time domain to the frequency domain, e.g., by taking a Fourier transform, and the resulting equation may be solved for the frequency domain output signal Y(k). This is equivalent to performing a Fourier transform (e.g., with a fast Fourier transform (fft)) for J+1 frames where each frequency bin in the Fourier transform is a (J+1)×1 column vector. The number of frequency bins is equal to N+1.

The finite impulse response filter coefficients $b_{ij}$ for each row of the equation above may be determined by taking a Fourier transform of x(t) and determining the $b_{ij}$ through semi-blind source separation. Specifically, for each "row" of the above equation becomes:

$$X_0 = FT(x(t, t-1, \ldots, t-N)) = [X_{00}, X_{01}, \ldots, X_{0N}]$$

$$X_1 = FT(x(t-1, t-2, \ldots, t-(N+1)) = [X_{10}, X_{11}, \ldots, X_{1N}]$$

$$\vdots$$

$$X_J = FT(x(t, t-1, \ldots, t-(N+J))) = [X_{J0}, X_{J1}, \ldots, X_{JN}],$$

where FT( ) represents the operation of taking the Fourier transform of the quantity in parentheses.

Furthermore, although the preceding deals with only a single microphone, embodiments of the invention may use arrays of two or more microphones. In such cases the input signal x(t) may be represented as an M+1-dimensional vector: $x(t)=(x_0(t), x_1(t), \ldots, x_M(t))$, where M+1 is the number of microphones in the array.

Figure 4B:
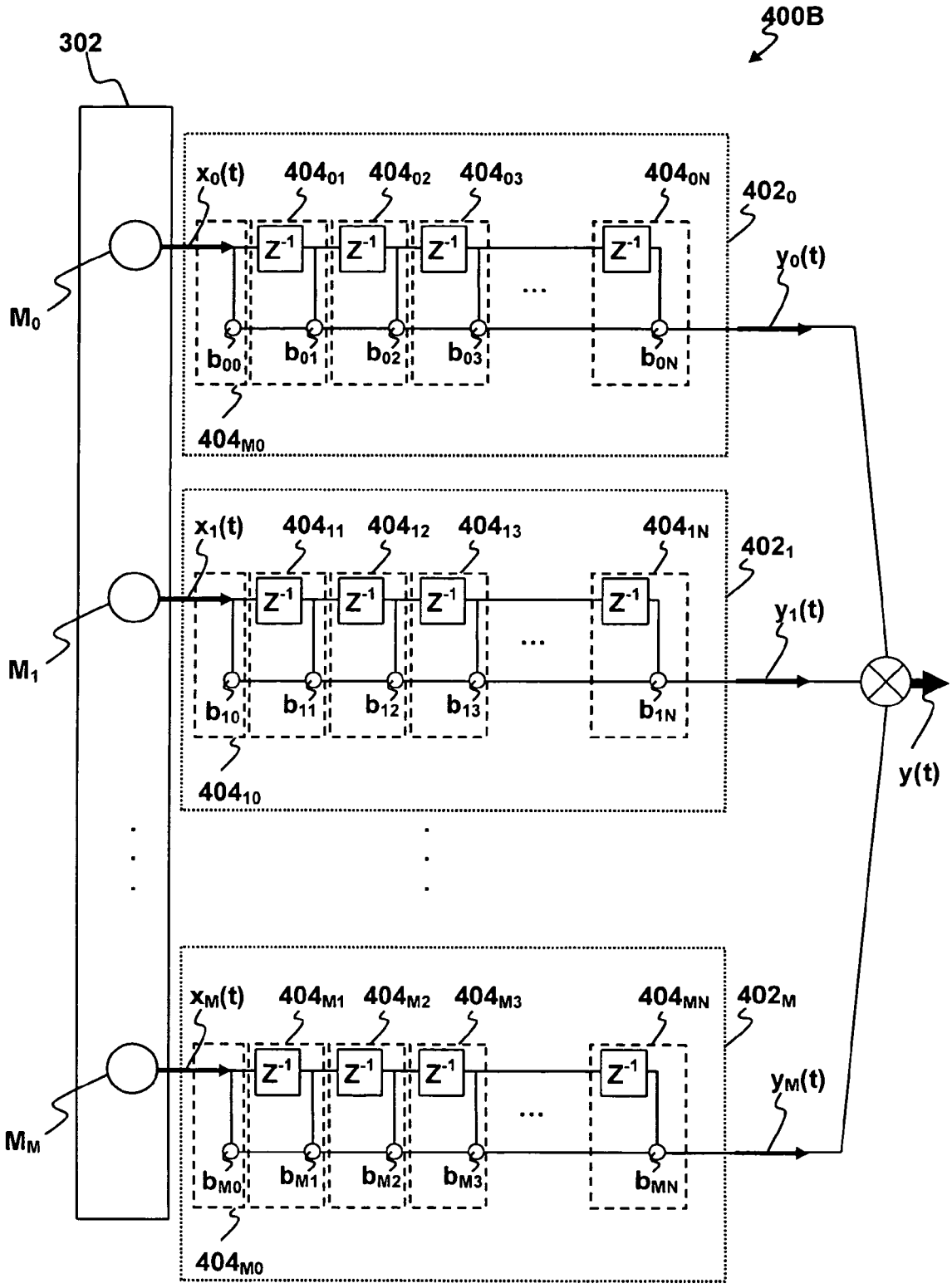
FIG. 4B is a schematic diagram of a microphone array and filter apparatus in which the methods and apparatuses for capturing an audio signal based on a location of the signal are implemented.

FIG. 4B depicts an apparatus 400B having microphone array 302 of M+1 microphones $M_0, M_1 \ldots M_M$. Each microphone is connected to one of M+1 corresponding filters $\mathbf{402}_0$, $\mathbf{402}_1, \ldots, \mathbf{402}_M$. Each of the filters $\mathbf{402}_0$, $\mathbf{402}_1, \ldots, \mathbf{402}_M$ includes a corresponding set of N+1 filter taps $\mathbf{404}_{00}, \ldots, \mathbf{404}_{0N}, \mathbf{404}_{10}, \ldots, \mathbf{404}_{1N}, \mathbf{404}_{M0}, \ldots, \mathbf{404}_{MN}$. Each filter tap $\mathbf{404}_{mi}$ includes a finite impulse response filter bmi, where m=0 . . . M, i=0 . . . N. Except for the first filter tap $\mathbf{404}_{m0}$ in each filter $\mathbf{402}m$, the filter taps also include delays indicated by $Z^{-1}$. Each filter $\mathbf{402}_m$ produces a corresponding output $y_m(t)$, which may be regarded as the components of the combined output y(t) of the filters. Fractional delays may be applied to each of the output signals $y_m(t)$ as described above.

For an array having M+1 microphones, the quantities $X_j$ are generally (M+1)-dimensional vectors. By way of example, for a 4-channel microphone array, there are 4 input signals: $x_0(t)$, $x_1(t)$, $x_2(t)$, and $x_3(t)$. The 4-channel inputs $x_m(t)$ are transformed to the frequency domain, and collected as a 1×4 vector "$X_{jk}$". The outer product of the vector $X_{jk}$ becomes a 4×4 matrix, the statistical average of this matrix becomes a "Covariance" matrix, which shows the correlation between every vector element.

By way of example, the four input signals $x_0(t)$, $x_1(t)$, $x_2(t)$ and $x_3(t)$ may be transformed into the frequency domain with J+1=10 blocks. Specifically:

For channel 0:

$$X_{00}=FT([x_0(t-0), x_0(t-1), x_0(t-2), \ldots x_0(t-N-1+0)])$$

$$X_{01}=FT([x_0(t-1), x_0(t-2), x_0(t-3), \ldots x_0(t-N-1+1)])$$

$$\ldots$$

$$X_{09}=FT([x_0(t-9), x_0(t-10)\, x_0(t-2), \ldots x_0(t-N-1+10)])$$

For channel 1:

$$X_{01}=FT([x_1(t-0), x_1(t-1), x_1(t-2), \ldots x_1(t-N-1+0)])$$

$$X_{11}=FT([x_1(t-1), x_1(t-2), x_1(t-3), \ldots x_1(t-N-1+1)])$$

$$\ldots$$

$$X_{19}=FT([x_1(t-9), x_1(t-10)\, x_1(t-2), \ldots x_1(t-N-1+10)])$$

For channel 2:

$$X_{20}=FT([x_2(t-0), x_2(t-1), x_2(t-2), \ldots x_2(t-N-1+0)])$$

$$X_{21}=FT([x_2(t-1), x_2(t-2), x_2(t-3), \ldots x_2(t-N-1+1)])$$

$$\ldots$$

$$X_{29}=FT([x_2(t-9), x_2(t-10)\, x_2(t-2), \ldots x_2(t-N-1+10)])$$

For channel 3:

$$X_{30}=FT([x_3(t-0), x_3(t-1), x_3(t-2), \ldots x_3(t-N-1+0)])$$

$$X_{31}=FT([x_3(t-1), x_3(t-2), x_3(t-3), \ldots x_3(t-N-1+1)])$$

$$\ldots$$

$$X_{39}=FT([x_3(t-9), x_3(t-10)\, x_3(t-2), \ldots x_3(t-N-1+10)])$$

By way of example 10 frames may be used to construct a fractional delay. For every frame j, where j=0:9, for every frequency bin <k>, where n=0:N−1, one can construct a 1×4 vector:

$$X_{jk}=[X_{0j}(k), X_{1j}(k), X_{2j}(k), X_{3j}(k)]$$

the vector $X_{jk}$ is fed into the SBSS algorithm to find the filter coefficients $b_{jn}$. The SBSS algorithm is an independent component analysis (ICA) based on $2^{nd}$-order independence, but the mixing matrix A (e.g., a 4×4 matrix for 4-mic-array) is replaced with 4×1 mixing weight vector $b_{jk}$, which is a diagonal of $A1=A*C^{-1}$ (i.e., $b_{jk}$=Diagonal (A1)), where $C^{-1}$ is the inverse eigenmatrix obtained from the calibration procedure described above. It is noted that the frequency domain calibration signal vectors $X'_{jk}$ may be generated as described in the preceding discussion.

The mixing matrix A may be approximated by a runtime covariance matrix $Cov(j,k)=E((X_{jk})^T*X_{jk})$, where E refers to the operation of determining the expectation value and $(X_{jk})^T$ is the transpose of the vector $X_{jk}$. The components of each vector $b_{jk}$ are the corresponding filter coefficients for each frame j and each frequency bin k, i.e., $$b_{jk}=[b_{0j}(k), b_{1j}(k), b_{2j}(k), b_{3j}(k)].$$

The independent frequency-domain components of the individual sound sources making up each vector $X_{jk}$ may be determined from:

$$S(j,k)^T=b_{jk}^{-1}\cdot X_{jk}=[(b_{0j}(k))^{-1}X_{0j}(k), (b_{1j}(k))^{-1}X_{1j}(k), (b_{2j}(k))^{-1}X_{2j}(k), (b_{3j}(k))^{-1}X_{3j}(k)]$$

where each $S(j,k)^T$ is a 1×4 vector containing the independent frequency-domain components of the original input signal x(t).

The ICA algorithm is based on "Covariance" independence, in the microphone array 302. It is assumed that there are always M+1 independent components (sound sources) and that their 2nd-order statistics are independent. In other words, the cross-correlations between the signals $x_0(t)$, $x_1(t)$, $x_2(t)$ and $x_3(t)$ should be zero. As a result, the non-diagonal elements in the covariance matrix Cov(j,k) should be zero as well.

By contrast, if one considers the problem inversely, if it is known that there are M+1 signal sources one can also determine their cross-correlation "covariance matrix", by finding a matrix A that can de-correlate the cross-correlation, i.e., the matrix A can make the covariance matrix Cov(j,k) diagonal (all non-diagonal elements equal to zero), then A is the "unmixing matrix" that holds the recipe to separate out the 4 sources.

Because solving for "unmixing matrix A" is an "inverse problem", it is actually very complicated, and there is normally no deterministic mathematical solution for A. Instead an initial guess of A is made, then for each signal vector $x_m(t)$ (m=0, 1 . . . M), A is adaptively updated in small amounts (called adaptation step size). In the case of a four-microphone array, the adaptation of A normally involves determining the inverse of a 4×4 matrix in the original ICA algorithm. Hopefully, adapted A will converge toward the true A. According to embodiments of the present invention, through the use of semi-blind-source-separation, the unmixing matrix A becomes a vector A1, since it is has already been decorrelated by the inverse eigenmatrix $C^{-1}$ which is the result of the prior calibration described above.

Multiplying the run-time covariance matrix Cov(j,k) with the pre-calibrated inverse eigenmatrix $C^{-1}$ essentially picks up the diagonal elements of A and makes them into a vector A1. Each element of A1 is the strongest cross-correlation, the inverse of A will essentially remove this correlation. Thus, embodiments of the present invention simplify the conventional ICA adaptation procedure, in each update, the inverse of A becomes a vector inverse $b^{-1}$. It is noted that computing a matrix inverse has N-cubic complexity, while computing a vector inverse has N-linear complexity. Specifically, for the case of N=4, the matrix inverse computation requires 64 times more computation that the vector inverse computation.

Also, by cutting a (M+1)×(M+1) matrix to a (M+1)×1 vector, the adaptation becomes much more robust, because it requires much fewer parameters and has considerably less problems with numeric stability, referred to mathematically as "degree of freedom". Since SBSS reduces the number of degrees of freedom by (M+1) times, the adaptation convergence becomes faster. This is highly desirable since, in real world acoustic environment, sound sources keep changing, i.e., the unmixing matrix A changes very fast. The adaptation of A has to be fast enough to track this change and converge to its true value in real-time. If instead of SBSS one uses a conventional ICA-based BSS algorithm, it is almost impossible to build a real-time application with an array of more than two microphones. Although some simple microphone arrays use BSS, most, if not all, use only two microphones.

The frequency domain output Y(k) may be expressed as an N+1 dimensional vector $Y=[Y_0, Y_1, \ldots, Y_N]$, where each component $Y_i$ may be calculated by:

$$Y_i = [\, X_{i0} \quad X_{i1} \quad \cdots \quad X_{iJ} \,] \cdot \begin{bmatrix} b_{i0} \\ b_{i1} \\ \vdots \\ b_{iJ} \end{bmatrix}$$

Each component $Y_i$ may be normalized to achieve a unit response for the filters.

$$Y_i' = \frac{Y_i}{\sqrt{\sum_{j=0}^{J} (b_{ij})^2}}$$

Although in embodiments of the invention N and J may take on any values, it has been shown in practice that N=511 and J=9 provides a desirable level of resolution, e.g., about 1/10 of a wavelength for an array containing 16 kHz microphones.

Figure 5:
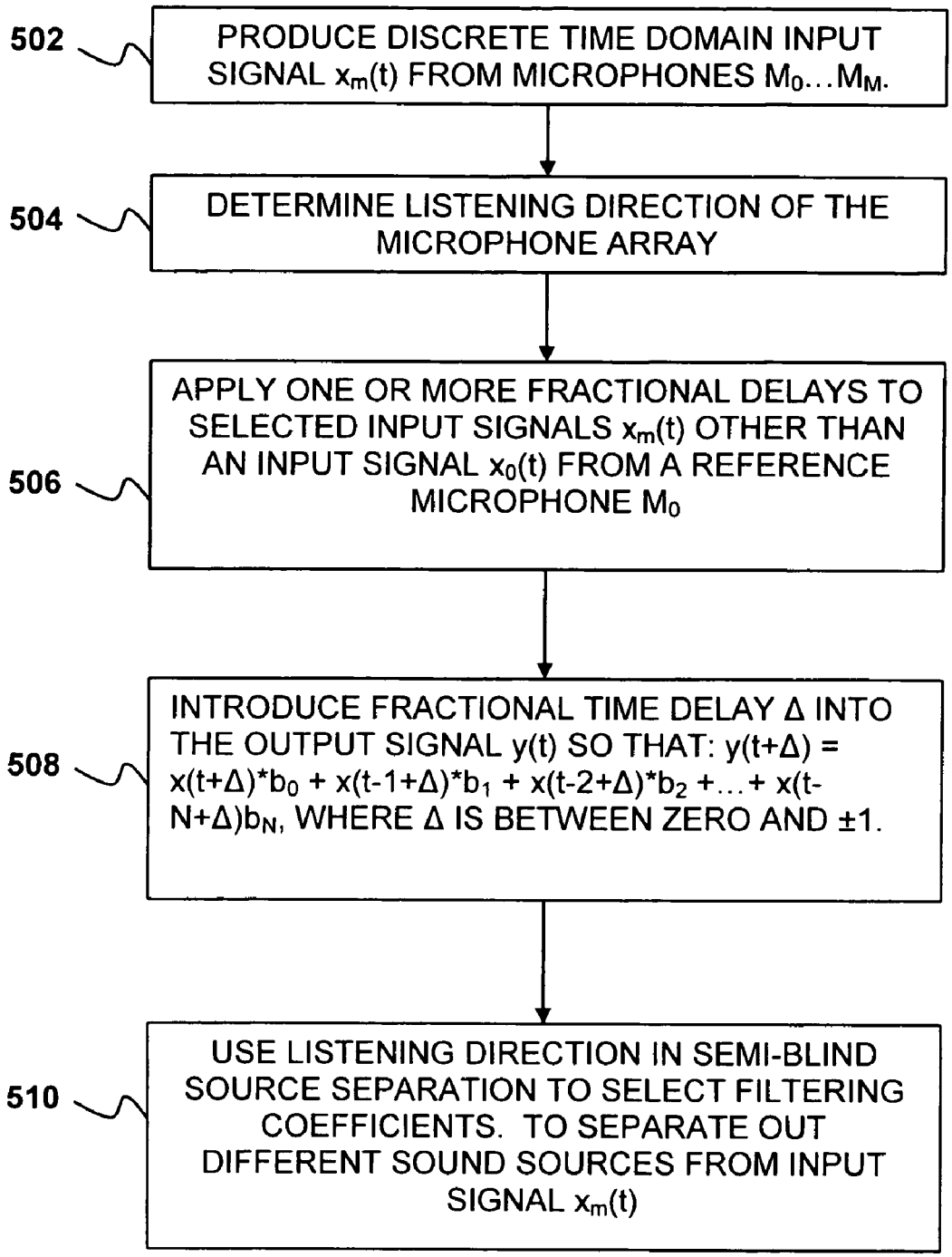
FIG. 5 is a flow diagram for processing a signal from an array of two or more microphones consistent with one embodiment of the methods and apparatuses for capturing an audio signal based on a location of the signal

FIG. 5 depicts a flow diagram illustrating one embodiment of the invention. In Block 502, a discrete time domain input signal $x_m(t)$ may be produced from microphones $M_0 \ldots M_M$. In Block 504, a listening direction may be determined for the microphone array, e.g., by computing an inverse eigenmatrix $C^{-1}$ for a calibration covariance matrix as described above. As discussed above, the listening direction may be determined during calibration of the microphone array during design or manufacture or may be re-calibrated at runtime. Specifically, a signal from a source located in a preferred listening direction with respect to the microphone may be recorded for a predetermined period of time. Analysis frames of the signal may be formed at predetermined intervals and the analysis frames may be transformed into the frequency domain. A calibration covariance matrix may be estimated from a vector of the analysis frames that have been transformed into the frequency domain. An eigenmatrix C of the calibration covariance matrix may be computed and an inverse of the eigenmatrix provides the listening direction.

In Block 506, one or more fractional delays may be applied to selected input signals $x_m(t)$ other than an input signal $x_0(t)$ from a reference microphone $M_0$. Each fractional delay is selected to optimize a signal to noise ratio of a discrete time domain output signal y(t) from the microphone array. The fractional delays are selected to such that a signal from the reference microphone $M_0$ is first in time relative to signals from the other microphone(s) of the array.

In Block 508, a fractional time delay Δ is introduced into the output signal y(t) so that: $y(t+\Delta)=x(t+\Delta)*b_0+x(t-1+\Delta)*b_1+x(t-2+\Delta)*b_2+\ldots+x(t-N+\Delta)b_N$, where Δ is between zero and ±1. The fractional delay may be introduced as described above with respect to FIGS. 4A and 4B. Specifically, each time domain input signal $x_m(t)$ may be delayed by j+1 frames and the resulting delayed input signals may be transformed to a frequency domain to produce a frequency domain input signal vector $X_{jk}$ for each of k=0:N frequency bins.

In Block 510, the listening direction (e.g., the inverse eigenmatrix $C^{-1}$) determined in the Block 504 is used in a semi-blind source separation to select the finite impulse response filter coefficients $b_0, b_1, \ldots, b_N$ to separate out different sound sources from input signal $x_m(t)$. Specifically, filter coefficients for each microphone m, each frame j and each frequency bin k, $[b_{0j}(k), b_{1j}(k), \ldots b_{Mj}(k)]$ may be computed that best separate out two or more sources of sound from the input signals $x_m(t)$. Specifically, a runtime covariance matrix may be generated from each frequency domain input signal vector $X_{jk}$. The runtime covariance matrix may be multiplied by the inverse $C^{-1}$ of the eigenmatrix C to produce a mixing matrix A and a mixing vector may be obtained from a diagonal of the mixing matrix A. The values of filter coefficients may be determined from one or more components of the mixing vector. Further, the filter coefficients may represent a location relative to the microphone array in one embodiment. In another embodiment, the filter coefficients may represent an area relative to the microphone array.

Figure 6:
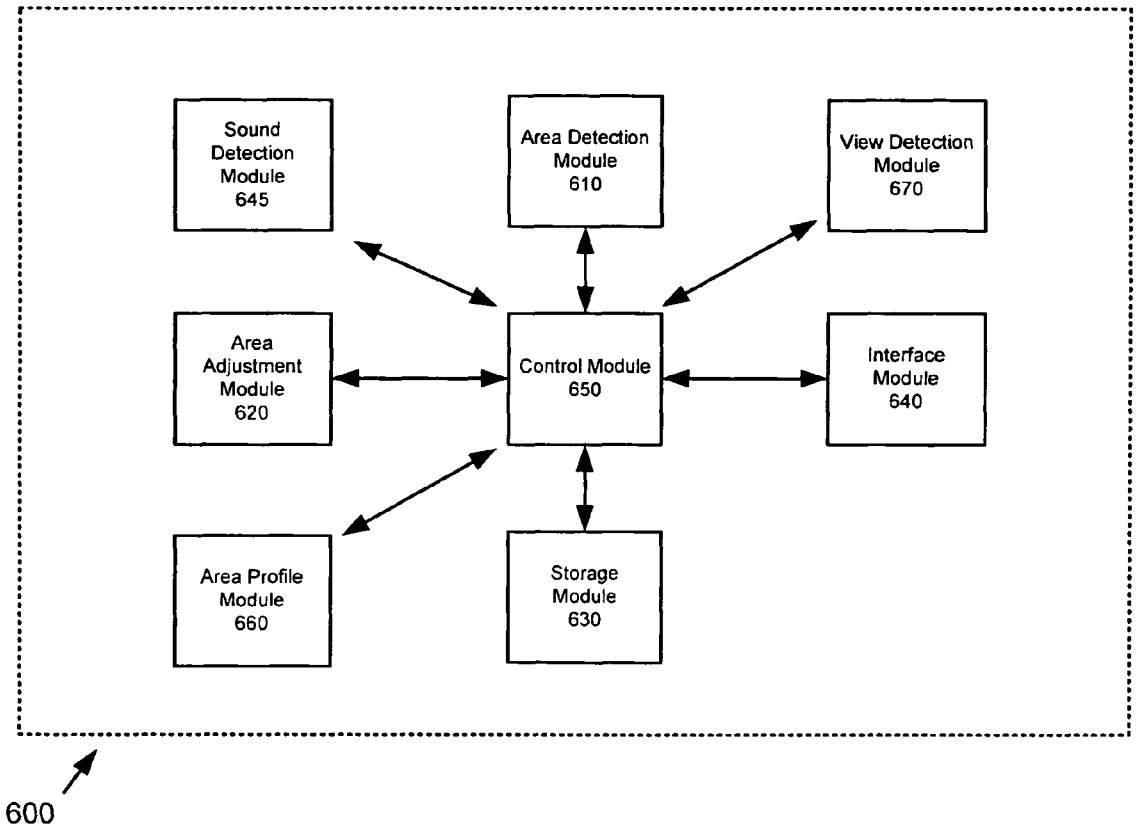
FIG. 6 is a simplified block diagram illustrating a system, consistent with one embodiment of the methods and apparatuses for capturing an audio signal based on a location of the signal.

FIG. 6 illustrates one embodiment of a system 600 for capturing an audio signal based on a location of the signal. The system 600 includes an area detection module 610, an area adjustment module 620, a storage module 630, an interface module 640, a sound detection module 645, a control module 650, an area profile module 660, and a view detection module 670. In one embodiment, the control module 650 communicates with the area detection module 610, the area adjustment module 620, the storage module 630, the interface module 640, the sound detection module 645, the area profile module 660, and the view detection module 670.

In one embodiment, the control module 650 coordinates tasks, requests, and communications between the area detection module 610, the area adjustment module 620, the storage module 630, the interface module 640, the sound detection module 645, the area profile module 660, and the view detection module 670.

In one embodiment, the area detection module 610 detects the listening zone that is being monitored for sounds. In one embodiment, a microphone array detects the sounds through a particular electronic device 110. For example, a particular listening zone that encompasses a predetermined area can be monitored for sounds originating from the particular area. In one embodiment, the listening zone is defined by finite impulse response filter coefficients b0, b1 . . . , bN.

In one embodiment, the area adjustment module 620 adjusts the area defined by the listening zone that is being monitored for sounds. For example, the area adjustment module 620 is configured to change the predetermined area that comprises the specific listening zone as defined by the area detection module 610. In one embodiment, the predetermined area is enlarged. In another embodiment, the predetermined area is reduced. In one embodiment, the finite impulse response filter coefficients b0, b1 . . . , bN are modified to reflect the change in area of the listening zone.

In one embodiment, the storage module 630 stores a plurality of profiles wherein each profile is associated with a different specifications for detecting sounds. In one embodiment, the profile stores various information as shown in an exemplary profile in FIG. 7. In one embodiment, the storage module 630 is located within the server device 130. In another embodiment, portions of the storage module 630 are located within the electronic device 110. In another embodiment, the storage module 630 also stores a representation of the sound detected.

In one embodiment, the interface module 640 detects the electronic device 110 as the electronic device 110 is connected to the network 120.

In another embodiment, the interface module 440 detects input from the interface device 115 such as a keyboard, a mouse, a microphone, a still camera, a video camera, and the like.

In yet another embodiment, the interface module 640 provides output to the interface device 115 such as a display, speakers, external storage devices, an external network, and the like.

In one embodiment, the sound detection module 645 is configured to detect sound that originates within the listening zone. For example, a signal from a microphone or microphone array of any of the types described herein may be coupled to the sound detection module 645. In one embodiment, the listening zone is determined by the area detection module 610. In another embodiment, the listening zone is determined by the area adjustment module 620.

In one embodiment, the sound detection module 645 captures the sound originating from the listening zone. In another embodiment, the sound detection module 645 detects a location of the sound within the listening zone. The location of the sound may be expressed in terms of finite impulse response filter coefficients b0, b1 . . . , bN.

In one embodiment, the area profile module 660 processes profile information related to the specific listening zones for sound detection. For example, the profile information may include parameters that delineate the specific listening zones that are being detected for sound. These parameters may include finite impulse response filter coefficients b0, b1 . . . , bN.

Figure 7:
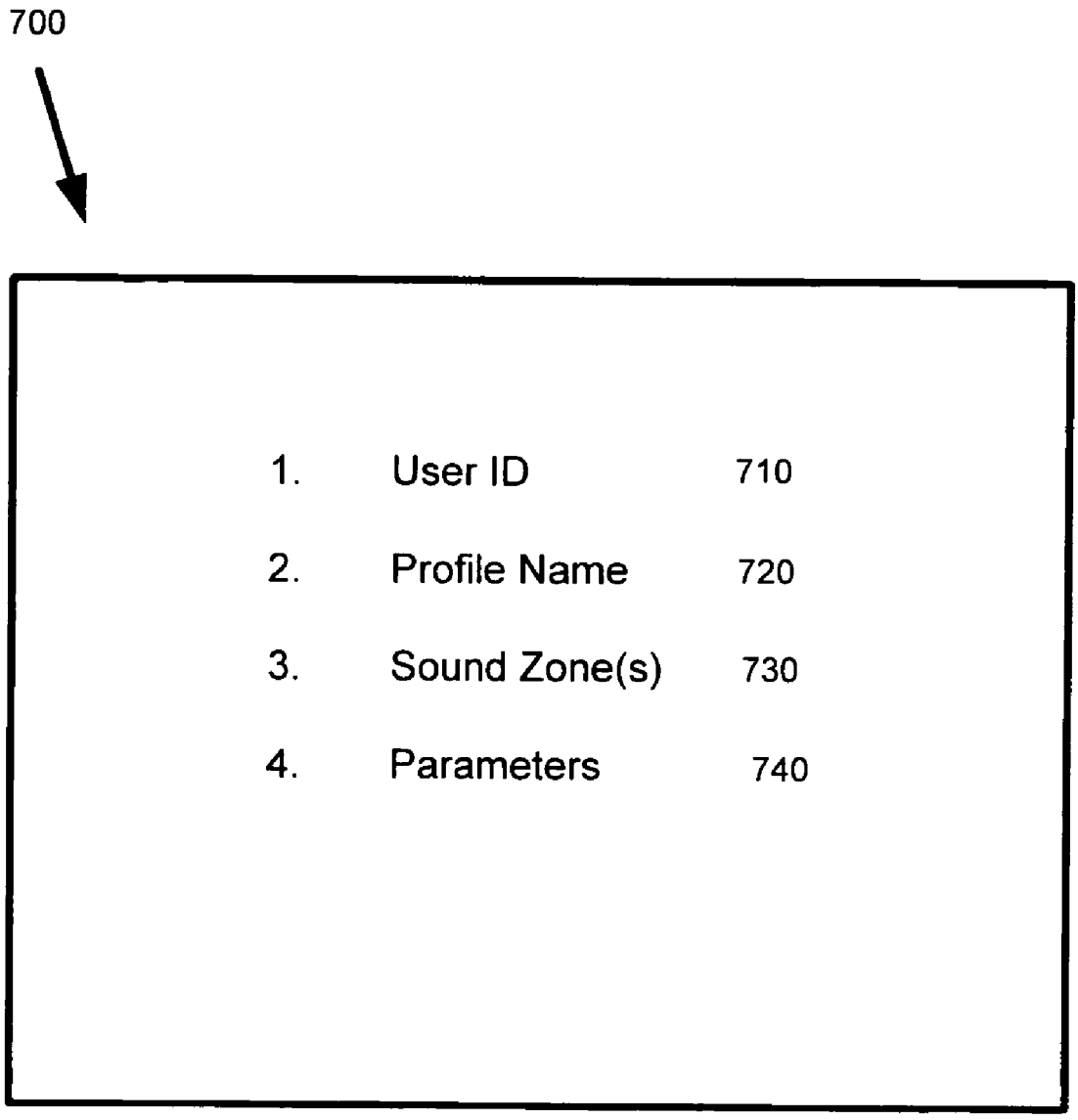
FIG. 7 illustrates an exemplary record consistent with one embodiment of the methods and apparatuses for capturing an audio signal based on a location of the signal.

In one embodiment, exemplary profile information is shown within a record illustrated in FIG. 7. In one embodiment, the area profile module 660 utilizes the profile information. In another embodiment, the area profile module 660 creates additional records having additional profile information.

In one embodiment, the view detection module 670 detects the field of view of a visual device such as a still camera or video camera. For example, the view detection module 670 is configured to detect the viewing angle of the visual device as seen through the visual device. In one instance, the view detection module 670 detects the magnification level of the visual device. For example, the magnification level may be included within the metadata describing the particular image frame. In another embodiment, the view detection module 670 periodically detect the field of view such that as the visual device zooms in or zooms out, the current field of view is detected by the view detection module 670.

In another embodiment, the view detection module 670 detects the horizontal and vertical rotational positions of the visual device relative to the microphone array.

The system 600 in FIG. 6 is shown for exemplary purposes and is merely one embodiment of the methods and apparatuses for capturing an audio signal based on a location of the signal. Additional modules may be added to the system 600 without departing from the scope of the methods and apparatuses for capturing an audio signal based on a location of the signal. Similarly, modules may be combined or deleted without departing from the scope of the methods and apparatuses for capturing an audio signal based on a location of the signal.

FIG. 7 illustrates a simplified record 700 that corresponds to a profile that describes the listening area. In one embodiment, the record 700 is stored within the storage module 630 and utilized within the system 600. In one embodiment, the record 700 includes a user identification field 710, a profile name field 720, a listening zone field 730, and a parameters field 740.

In one embodiment, the user identification field 710 provides a customizable label for a particular user. For example, the user identification field 710 may be labeled with arbitrary names such as "Bob", "Emily's Profile", and the like.

In one embodiment, the profile name field 720 uniquely identifies each profile for detecting sounds. For example, in one embodiment, the profile name field 720 describes the location and/or participants. For example, the profile name field 720 may be labeled with a descriptive name such as "The XYZ Lecture Hall", "The Sony PlayStation® ABC Game", and the like. Further, the profile name field 520 may be further labeled "The XYZ Lecture Hall with half capacity", The Sony PlayStation® ABC Game with 2 other Participants", and the like.

In one embodiment, the listening zone field 730 identifies the different areas that are to be monitored for sounds. For example, the entire XYZ Lecture Hall may be monitored for sound. However, in another embodiment, selected portions of the XYZ Lecture Hall are monitored for sound such as the front section, the back section, the center section, the left section, and/or the right section.

In another example, the entire area surrounding the Sony PlayStation® may be monitored for sound. However, in another embodiment, selected areas surrounding the Sony PlayStation® are monitored for sound such as in front of the Sony PlayStation®, within a predetermined distance from the Sony PlayStation®, and the like.

In one embodiment, the listening zone field 730 includes a single area for monitoring sounds. In another embodiment, the listening zone field 730 includes multiple areas for monitoring sounds.

In one embodiment, the parameter field 740 describes the parameters that are utilized in configuring the sound detection device to properly detect sounds within the listening zone as described within the listening zone field 730.

In one embodiment, the parameter field 740 includes finite impulse response filter coefficients b0, b1 . . . , bN.

The flow diagrams as depicted in FIGS. 8, 9, 10, and 11 are one embodiment of the methods and apparatuses for capturing an audio signal based on a location of the signal. The blocks within the flow diagrams can be performed in a different sequence without departing from the spirit of the methods and apparatuses for capturing an audio signal based on a location of the signal. Further, blocks can be deleted, added, or combined without departing from the spirit of the methods and apparatuses for capturing an audio signal based on a location of the signal.

Figure 8:
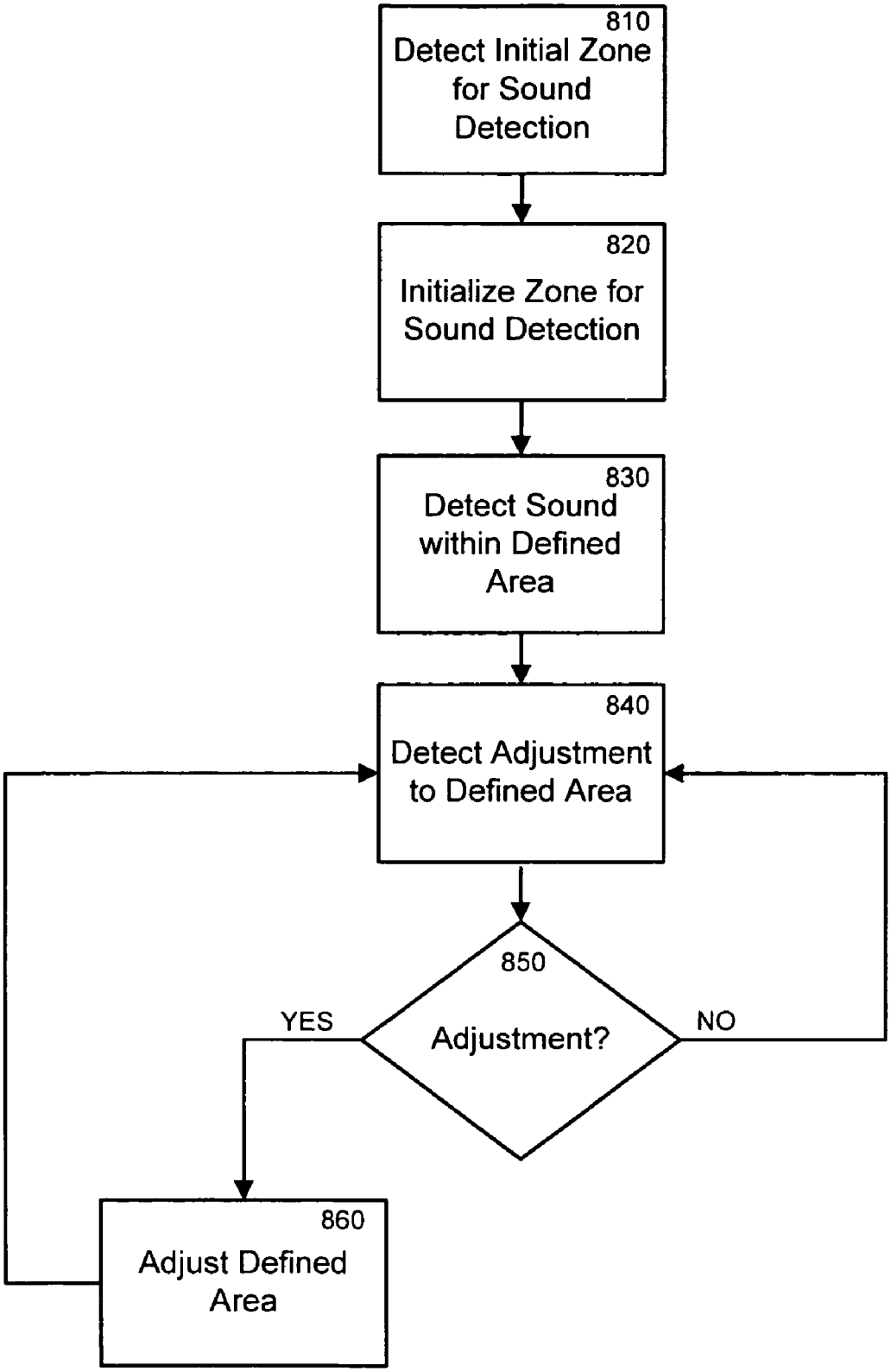
FIG. 8 is a flow diagram consistent with one embodiment of the methods and apparatuses for capturing an audio signal based on a location of the signal.

The flow diagram in FIG. 8 illustrates capturing an audio signal based on a location of the signal according to one embodiment of the invention.

In Block 810, an initial listening zone is identified for detecting sound. For example, the initial listening zone may be identified within a profile associated with the record 700. Further, the area profile module 660 may provide parameters associated with the initial listening zone.

In another example, the initial listening zone is pre-programmed into the particular electronic device 110. In yet another embodiment, the particular location such as a room, lecture hall, or a car are determined and defined as the initial listening zone.

In another embodiment, multiple listening zones are defined that collectively comprise the audibly detectable areas surrounding the microphone array. Each of the listening zones is represented by finite impulse response filter coefficients b0, b1 . . . , bN. The initial listening zone is selected from the multiple listening zones in one embodiment.

In Block 820, the initial listening zone is initiated for sound detection. In one embodiment, a microphone array begins detecting sounds. In one instance, only the sounds within the initial listening zone are recognized by the device 110. In one example, the microphone array may initially detect all sounds. However, sounds that originate or emanate from outside of the initial listening zone are not recognized by the device 110. In one embodiment, the area detection module 810 detects the sound originating from within the initial listening zone.

In Block 830, sound detected within the defined area is captured. In one embodiment, a microphone detects the sound. In one embodiment, the captured sound is stored within the storage module 630. In another embodiment, the sound detection module 645 detects the sound originating from the defined area. In one embodiment, the defined area includes the initial listening zone as determined by the Block 810. In another embodiment, the defined area includes the area corresponding to the adjusted defined area of the Block 860.

In Block 840, adjustments to the defined area are detected. In one embodiment, the defined area may be enlarged. For example, after the initial listening zone is established, the defined area may be enlarged to encompass a larger area to monitor sounds.

In another embodiment, the defined area may be reduced. For example, after the initial listening zone is established, the defined area may be reduced to focus on a smaller area to monitor sounds.

In another embodiment, the size of the defined area may remain constant, but the defined area is rotated or shifted to a different location. For example, the defined area may be pivoted relative to the microphone array.

Further, adjustments to the defined area may also be made after the first adjustment to the initial listening zone is performed.

In one embodiment, the signals indicating an adjustment to the defined area may be initiated based on the sound detected by the sound detection module 645, the field of view detected by the view detection module 670, and/or input received through the interface module 640 indicating a change an adjustment in the defined area.

In Block 850, if an adjustment to the defined area is detected, then the defined area is adjusted in Block 860. In one embodiment, the finite impulse response filter coefficients b0, b1 . . . , bN are modified to reflect an adjusted defined area in the Block 860. In another embodiment, different filter coefficients are utilized to reflect the addition or subtraction of listening zone(s).

In Block 850, if an adjustment to the defined area is not detected, then sound within the defined area is detected in the Block 830.

Figure 9:
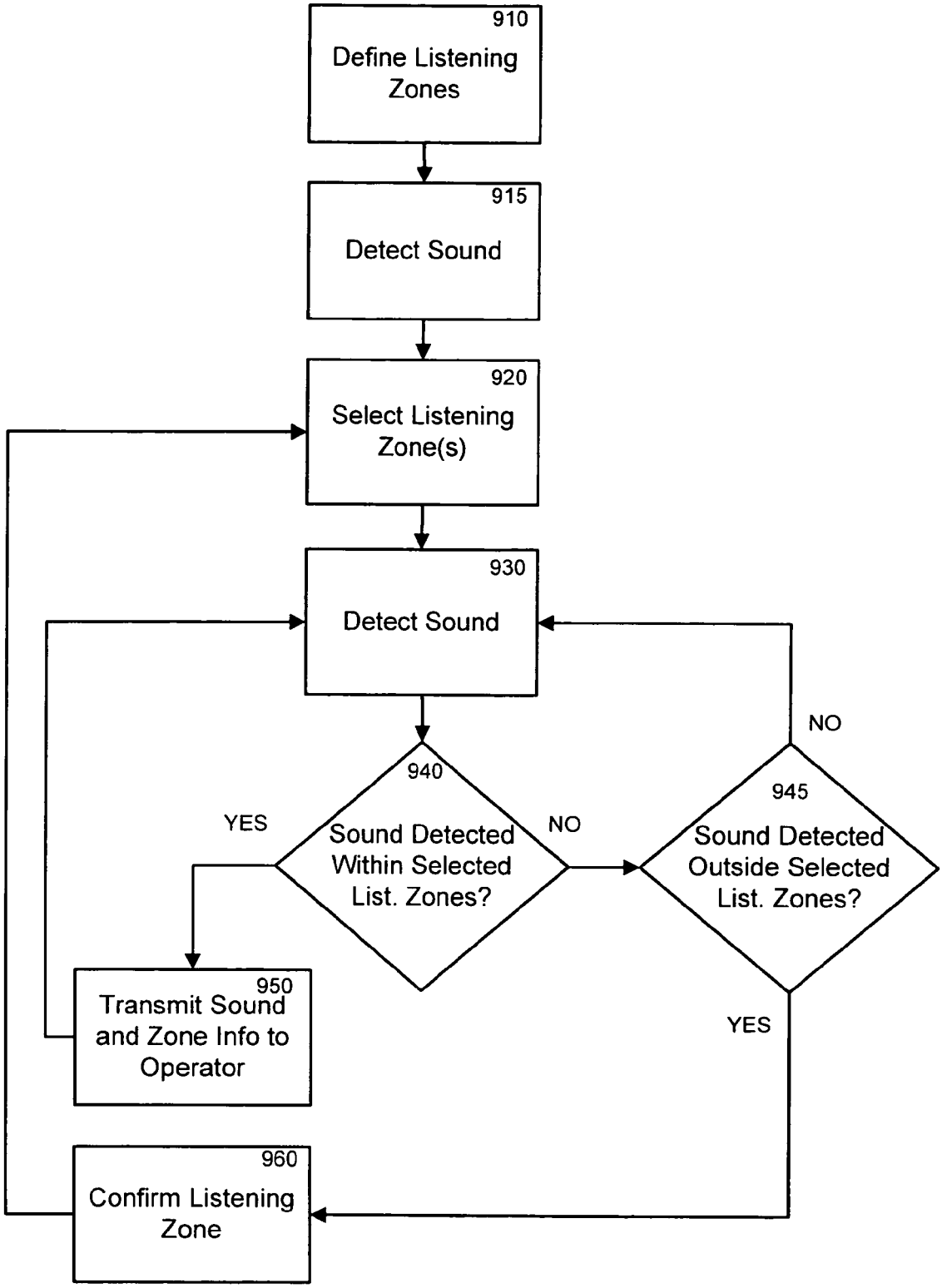
FIG. 9 is a flow diagram consistent with one embodiment of the methods and apparatuses for capturing an audio signal based on a location of the signal.

The flow diagram in FIG. 9 illustrates creating a listening zone, selecting a listening zone, and monitoring sounds according to one embodiment of the invention.

In Block 910, the listening zones are defined. In one embodiment, the field covered by the microphone array includes multiple listening zones. In one embodiment, the listening zones are defined by segments relative to the microphone array. For example, the listening zones may be defined as four different quadrants such as Northeast, Northwest, Southeast, and Southwest, where each quadrant is relative to the location of the microphone array located at the center. In another example, the listening area may be divided into any number of listening zones. For illustrative purposes, the listening area may be defined by listening zones encompassing X number of degrees relative to the microphone array. If the entire listening area is a full coverage of 360 degrees around the microphone array, and there are 10 distinct listening zones, then each listening zone or segment would encompass 36 degrees.

In one embodiment, the entire area where sound can be detected by the microphone array is covered by one of the listening zones. In one embodiment, each of the listening zones corresponds with a set of finite impulse response filter coefficients b0, b1 . . . , bN.

In one embodiment, the specific listening zones may be saved within a profile stored within the record 700. Further, the finite impulse response filter coefficients b0, b1 . . . , bN may also be saved within the record 700.

In Block 915, sound is detected by the microphone array for the purpose of selecting a listening zone. The location of the detected sound may also be detected. In one embodiment, the location of the detected sound is identified through a set of finite impulse response filter coefficients b0, b1 . . . , bN.

In Block 920, at least one listening zone is selected. In one instance, the selection of particular listening zone(s) is utilized to prevent extraneous noise from interfering with sound intended to be detected by the microphone array. By limiting the listening zone to a smaller area, sound originating from areas that are not being monitored can be minimized.

In one embodiment, the listening zone is automatically selected. For example, a particular listening zone can be automatically selected based on the sound detected within the Block 915. The particular listening zone that is selected can correlate with the location of the sound detected within the Block 915. Further, additional listening zones can be selected that are in adjacent or proximal to listening zones relative to the detected sound. In another example, the particular listening zone is selected based on a profile within the record 700.

In another embodiment, the listening zone is manually selected by an operator. For example, the detected sound may be graphically displayed to the operator such that the operator can visually detect a graphical representation that shows which listening zone corresponds with the location of the detected sound. Further, selection of the particular listening zone(s) may be performed based on the location of the detected sound. In another example, the listening zone may be selected solely based on the anticipation of sound.

In Block 930, sound is detected by the microphone array. In one embodiment, any sound is captured by the microphone array regardless of the selected listening zone. In another embodiment, the information representing the sound detected is analyzed for intensity prior to further analysis. In one instance, if the intensity of the detected sound does not meet a predetermined threshold, then the sound is characterized as noise and is discarded.

In Block 940, if the sound detected within the Block 930 is found within one of the selected listening zones from the Block 920, then information representing the sound is transmitted to the operator in Block 950. In one embodiment, the information representing the sound may be played, recorded, and/or further processed.

In the Block 940, if the sound detected within the Block 930 is not found within one of the selected listening zones then further analysis is performed per Block 945.

If the sound is not detected outside of the selected listening zones within the Block 945, then detection of sound continues in the Block 930.

However, if the sound is detected outside of the selected listening zones within the Block 945, then a confirmation is requested by the operator in Block 960. In one embodiment, the operator is informed of the sound detected outside of the selected listening zones and is presented an additional listening zone that includes the region that the sound originates from within. In this example, the operator is given the opportunity to include this additional listening zone as one of the selected listening zones. In another embodiment, a preference of including or not including the additional listening zone can be made ahead of time such that additional selection by the operator is not requested. In this example, the inclusion or exclusion of the additional listening zone is automatically performed by the system 600.

After Block 960, the selected listening zones are updated in the Block 920 based on the selection in the Block 960. For example, if the additional listening zone is selected, then the additional listening zone is included as one of the selected listening zones.

Figure 10:
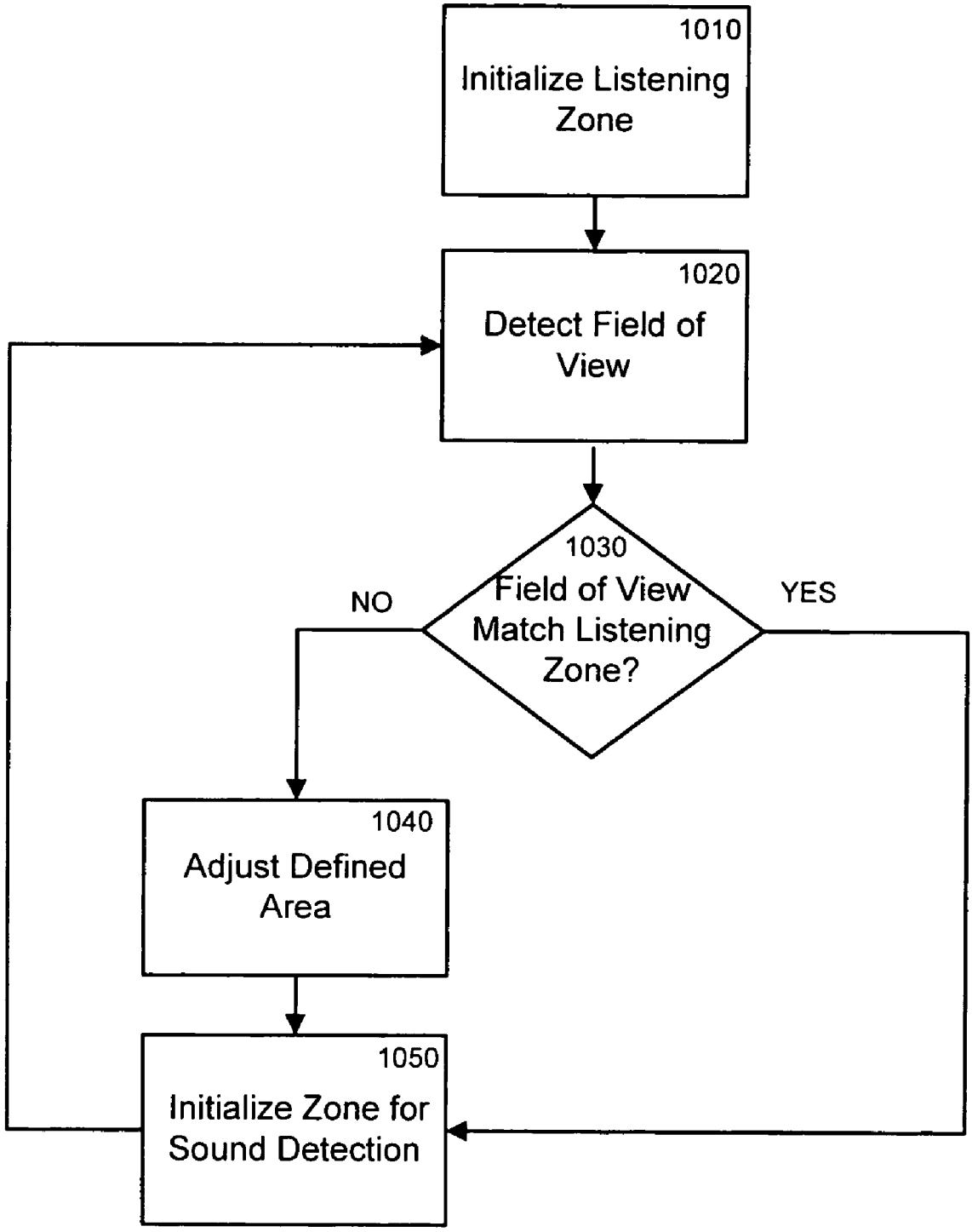
FIG. 10 is a flow diagram consistent with one embodiment of the methods and apparatuses for capturing an audio signal based on a location of the signal.

The flow diagram in FIG. 10 illustrates adjusting a listening zone based on the field of view according to one embodiment of the invention.

In Block 1010, a listening zone is selected and initialized. In one embodiment, a single listening zone is selected from a plurality of listening zones. In another embodiment, multiple listening zones are selected. In one embodiment, the microphone array monitors the listening zone. Further, a listening zone can be represented by finite impulse response filter coefficients b0, b1 . . . , bN or a predefined profile illustrated in the record 700.

In Block 1020, the field of view is detected. In one embodiment, the field of view represents the image viewed through a visual device such as a still camera, a video camera, and the like. In one embodiment, the view detection module 670 is utilized to detect the field of view. The current field of view can change as the effective focal length (magnification) of the visual device is varied. Further, the current view of field can also change if the visual device rotates relative to the microphone array.

In Block 1030, the current field of view is compared with the current listening zone(s). In one embodiment, the magnification of the visual device and the rotational relationship between the visual device and the microphone array are utilized to determine the field of view. This field of view of the visual device is compared with the current listening zone(s) for the microphone array.

If there is a match between the current field of view of the visual device and the current listening zone(s) of the microphone array, then sound is detected within the current listening zone(s) in Block 1050.

If there is not a match between the current field of view of the visual device and the current listening zone(s) of the microphone array, then the current listening zone is adjusted in Block 1040. If the rotational position of the current field of view and the current listening zone of the microphone array are not aligned, then a different listening zone is selected that encompasses the rotational position of the current field of view.

Further, in one embodiment, if the current field of view of the visual device is narrower than the current listening zones, then one of the current listening zones may be deactivated such that the deactivated listening zone is no longer able to detect sounds from this deactivated listening zone. In another embodiment, if the current field of view of the visual device is narrower than the single, current listening zone, then the current listening zone may be modified through manipulating the finite impulse response filter coefficients b0, b1 . . . , bN to reduce the area that sound is detected by the current listening zone.

Further, in one embodiment, if the current field of view of the visual device is broader than the current listening zone(s), then an additional listening zone that is adjacent to the current listening zone(s) may be added such that the additional listening zone increases the area that sound is detected. In another embodiment, if the current field of view of the visual device is broader than the single, current listening zone, then the current listening zone may be modified through manipulating the finite impulse response filter coefficients b0, b1 . . . , bN to increase the area that sound is detected by the current listening zone.

After adjustment to the listening zone in the Block 1040, sound is detected within the current listening zone(s) in Block 1050.

Figure 11:
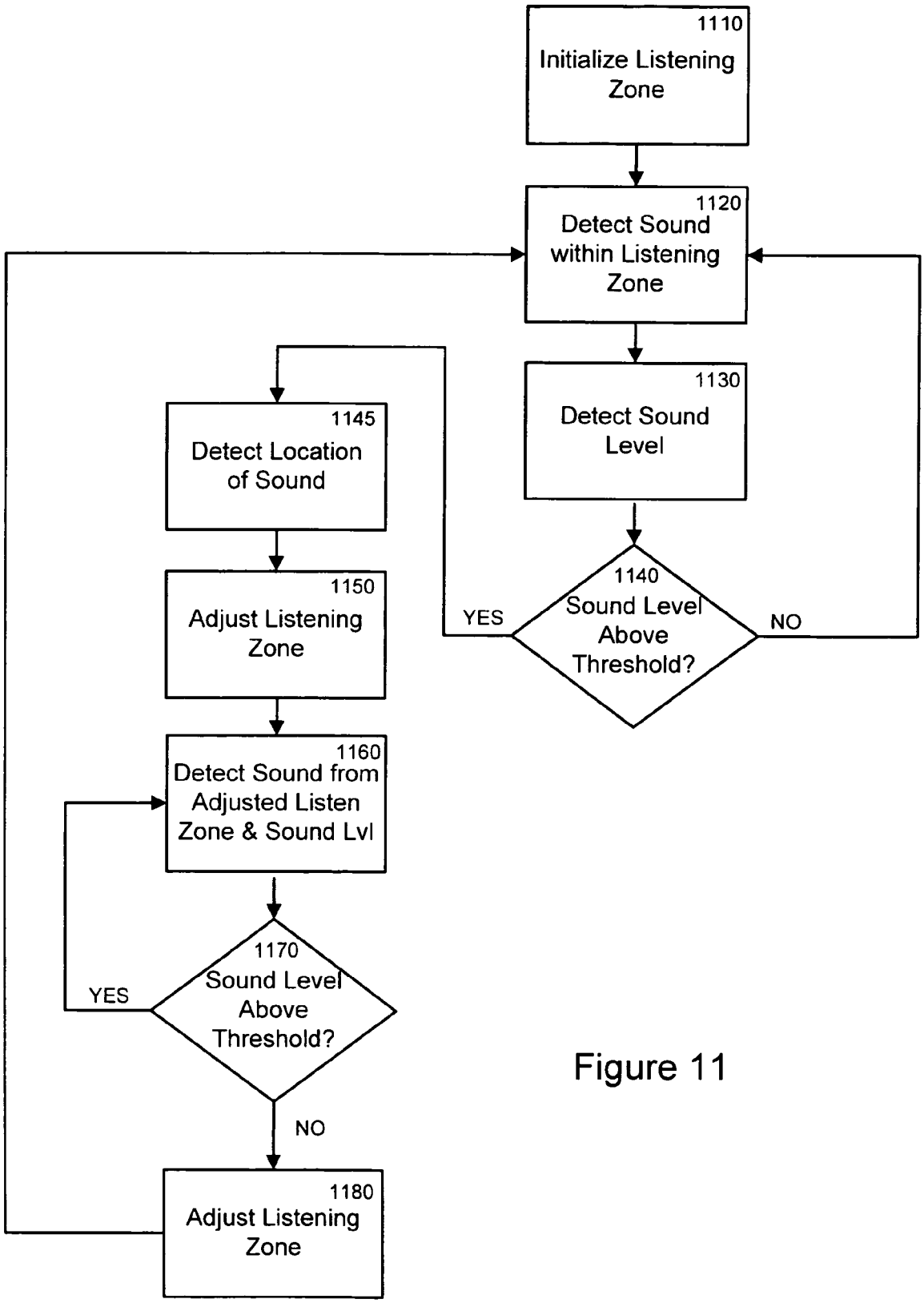
FIG. 11 is a flow diagram consistent with one embodiment of the methods and apparatuses for capturing an audio signal based on a location of the signal.

The flow diagram in FIG. 11 illustrates adjusting a listening zone based on the sound level according to one embodiment of the invention.

In Block 1110, a listening zone is selected and initialized. In one embodiment, a single listening zone is selected from a plurality of listening zones. In another embodiment, multiple listening zones are selected. In one embodiment, the microphone array monitors the listening zone. Further, a listening zone can be represented by finite impulse response filter coefficients b0, b1 . . . , bN or a predefined profile illustrated in the record 700.

In Block 1120, sound is detected within the current listening zone(s). In one embodiment, the sound is detected by the microphone array through the sound detection module 645.

In Block 1130, a sound level is determined from the sound detected within the Block 1120.

In Block 1140, the sound level determined from the Block 1130 is compared with a sound threshold level. In one embodiment, the sound threshold level is chosen based on sound models that exclude extraneous, unintended noise. In another embodiment, the sound threshold is dynamically chosen based on the current environment of the microphone array. For example, in a very quiet environment, the sound threshold may be set lower to capture softer sounds. In contrast, in a loud environment, the sound threshold may be set higher to exclude background noises.

If the sound level from the Block 1130 is below the sound threshold level as described within the Block 1140, then sound continues to be detected within the Block 1120.

If the sound level from the Block 1130 is above the sound threshold level as described within the Block 1140, then the location of the detected sound is determined in Block 1145. In one embodiment, the location of the detected sound is expressed in the form of finite impulse response filter coefficients b0, b1 . . . , bN.

In Block 1150, the listening zone that is initially selected in the Block 1110 is adjusted. In one embodiment, the area covered by the initial listening zone is decreased. For example, the location of the detected sound identified from the Block 1145 is utilized to focus the initial listening zone such that the initial listening zone is adjusted to include the area adjacent to the location of this sound.

In one embodiment, there may be multiple listening zones that comprise the initial listening zone. In this example with multiple listening zones, the listening zone that includes the location of the sound is retained as the adjusted listening zone. In a similar example, the listening zone that that includes the location of the sound and an adjacent listening zone are retained as the adjusted listening zone.

In another embodiment, there may be a single listening zone as the initial listening zone. In this example, the adjusted listening zone can be configured as a smaller area around the location of the sound. In one embodiment, the smaller area around the location of the sound can be represented by finite impulse response filter coefficients b0, b1 . . . , bN that identify the area immediately around the location of the sound.

In Block 1160, the sound is detected within the adjusted listening zone(s). In one embodiment, the sound is detected by the microphone array through the sound detection module 645. Further, the sound level is also detected from the adjusted listening zone(s). In addition, the sound detected within the adjusted listening zone(s) may be recorded, streamed, transmitted, and/or further processed by the system 600.

In Block 1170, the sound level determined from the Block 1160 is compared with a sound threshold level. In one embodiment, the sound threshold level is chosen to determine whether the sound originally detected within the Block 1120 is continuing.

If the sound level from the Block 1160 is above the sound threshold level as described within the Block 1170, then sound continues to be detected within the Block 1160.

If the sound level from the Block 1160 is below the sound threshold level as described within the Block 1170, then the adjusted listening zone(s) is further adjusted in Block 1180. In one embodiment, the adjusted listening zone reverts back to the initial listening zone shown in the Block 1110.

Figure 12:
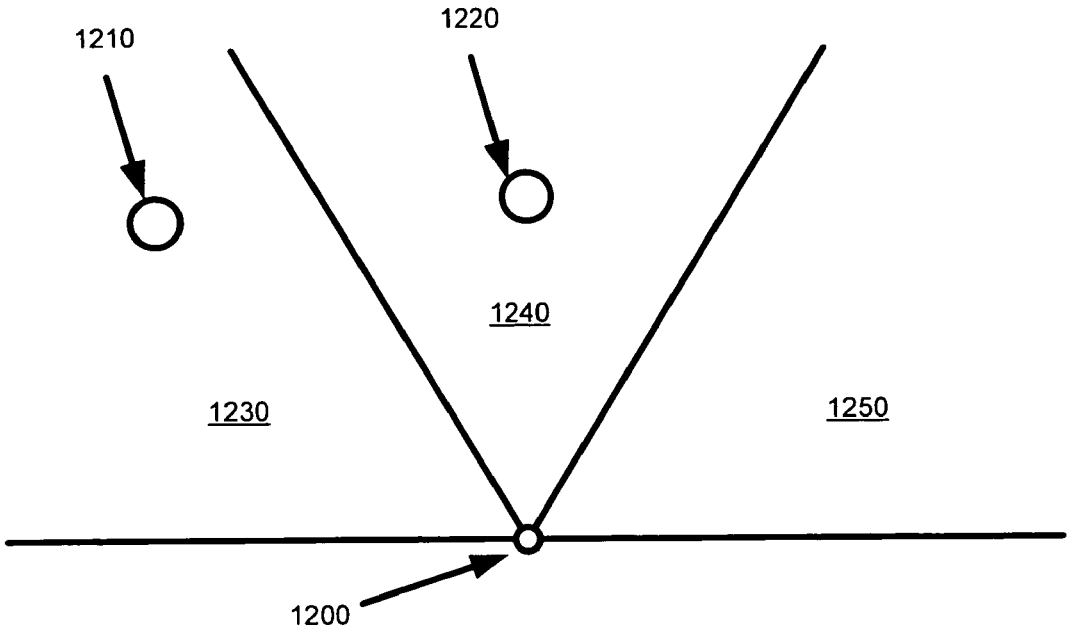
FIG. 12 is a diagram illustrating monitoring a listening zone based on a field of view consistent with one embodiment of the methods and apparatuses for capturing an audio signal based on a location of the signal.

FIG. 12 illustrates a diagram that illustrates a use of the field of view application as described within FIG. 10. FIG. 12 includes a microphone array and visual device 1200, and objects 1210, 1220. In one embodiment, the microphone array and visual device 1200 is a camcorder. The microphone array and visual device 1200 is capable of capturing sounds and visual images within regions 1230, 1240, and 1250. Further, the microphone array and visual device 1200 can adjust the field of view for capturing visual images and can adjust the listening zone for capturing sounds. The regions 1230, 1240, and 1250 are chosen as arbitrary regions. There can be fewer or additional regions that are larger or smaller in different instances.

In one embodiment, the microphone array and visual device 1200 captures the visual image of the region 1240 and the sound from the region 1240. Accordingly, the sound and visual image from the object 1220 will be captured. However, the sound and visual image from the object 1210 will not be captured in this instance.

In one instance, the visual image of the microphone array and visual device 1200 may be enlarged from the region 1240 to encompass the object 1210. Accordingly, the sound of the microphone array and visual device 1200 follows the visual field of view and also enlarges the listening zone from the region 1240 to encompass the object 1210.

In another instance, the visual image of the microphone array and visual device 1200 may cover the same footprint as the region 1240 but be rotated to encompass the object 1210. Accordingly, the sound of the microphone array and visual device 1200 follows the visual field of view and also rotates the listening zone from the region 1240 to encompass the object 1210.

Figure 13:
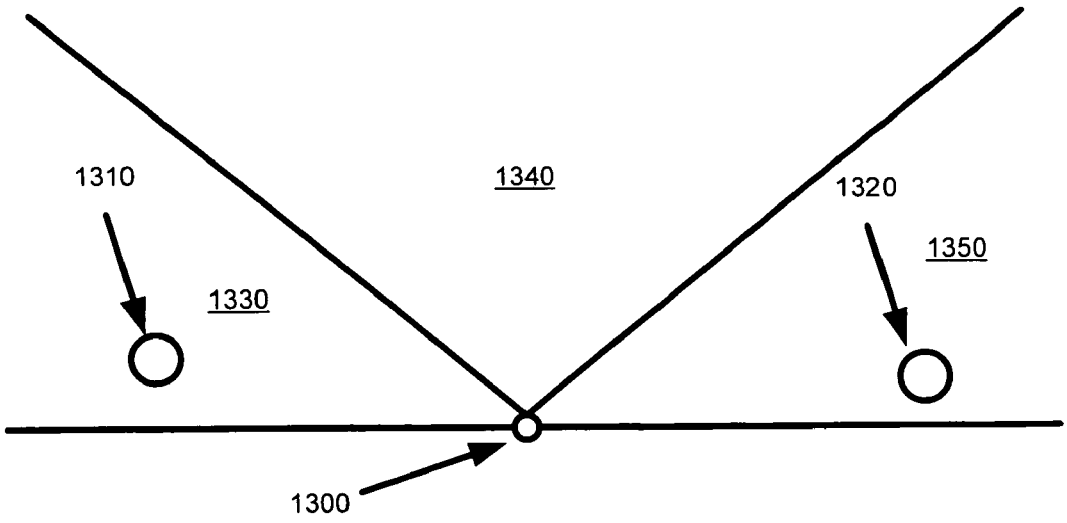
FIG. 13 is a diagram illustrating several listening zones consistent with one embodiment of the methods and apparatuses for capturing an audio signal based on a location of the signal.

FIG. 13 illustrates a diagram that illustrates a use of an application as described within FIG. 11. FIG. 13 includes a microphone array 1300, and objects 1310, 1320. The microphone array 1300 is capable of capturing sounds within regions 1330, 1340, and 1350. Further, the microphone array 1300 can adjust the listening zone for capturing sounds. The regions 1330, 1340, and 1350 are chosen as arbitrary regions. There can be fewer or additional regions that are larger or smaller in different instances.

In one embodiment, the microphone array 1300 monitors sounds from the regions 1330, 1340, and 1350. When the object 1320 produces a sound that exceeds the sound level threshold, then the microphone array 1300 narrows sound detection to the region 1350. After the sound from the object 1320 terminates, the microphone array 1300 is capable of detecting sounds from the regions 1330, 1340, and 1350.

In one embodiment, the microphone array 1300 can be integrated within a Sony PlayStation® gaming device. In this application, the objects 1310 and 1320 represent players to the left and right of the user of the PlayStation® device, respectively. In this application, the user of the PlayStation® device can monitor fellow players or friends on either side of the user while blocking out unwanted noises by narrowing the listening zone that is monitored by the microphone array 1300 for capturing sounds.

Figure 14:
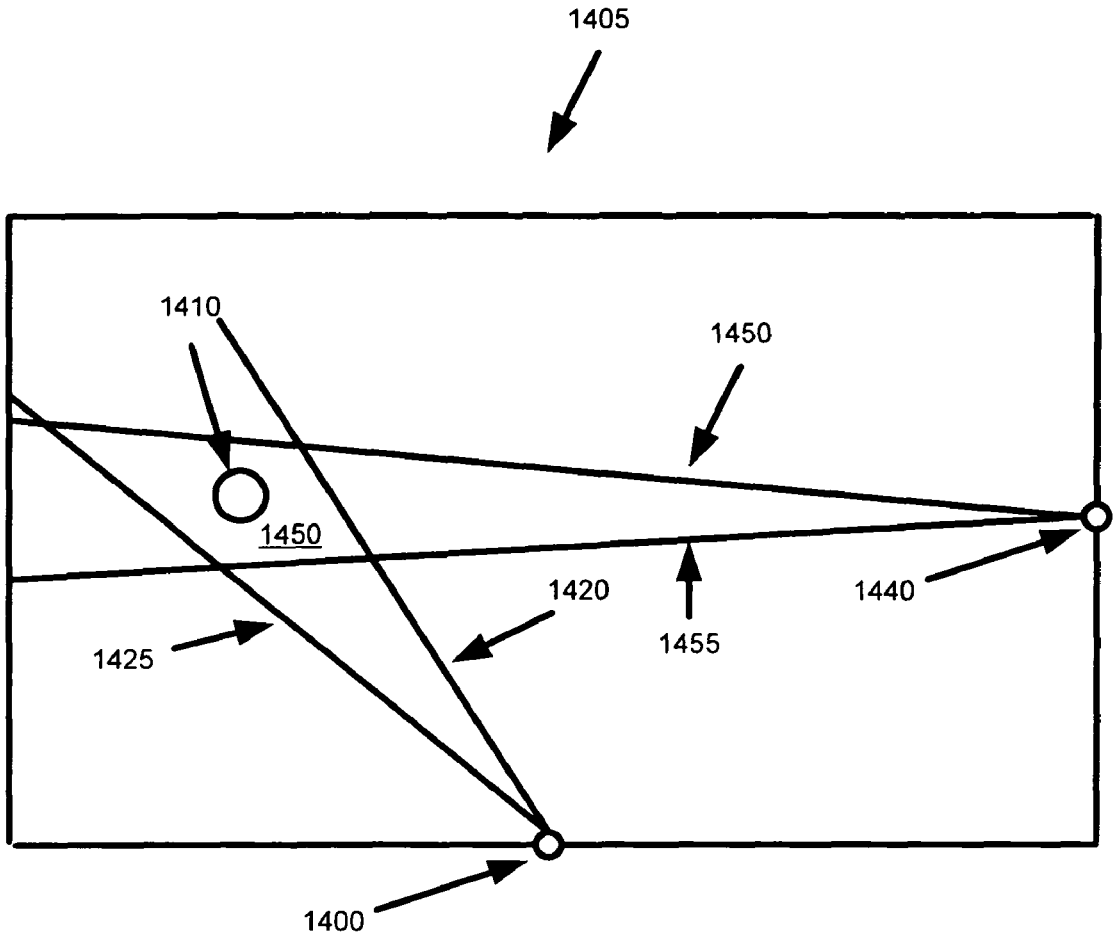
FIG. 14 is a diagram focusing sound detection consistent with one embodiment of the methods and apparatuses for capturing an audio signal based on a location of the signal.

FIG. 14 illustrates a diagram that illustrates a use of an application in conjunction with the system 600 as described within FIG. 6. FIG. 14 includes a microphone array 1400, an object 1410, and a microphone array 1440. The microphone arrays 1400 and 1440 are capable of capturing sounds within a region 1405 which includes a region 1450. Further, both microphone arrays 1400 and 1440 can adjust their respective listening zones for capturing sounds.

In one embodiment, the microphone arrays 1400 and 1440 monitor sounds within the region 1405. When the object 1410 produces a sound that exceeds the sound level threshold, then the microphone arrays 1400 and 1440 narrows sound detection to the region 1450. In one embodiment, the region 1450 is bounded by traces 1420, 1425, 1450, and 1455. After the sound terminates, the microphone arrays 1400 and 1440 return to monitoring sounds within the region 1405.

In another embodiment, the microphone arrays 1400 and 1440 are combined within a single microphone array that has a convex shape such that the single microphone array can be functionally substituted for the microphone arrays 1400 and 1440.

Figure 15A:
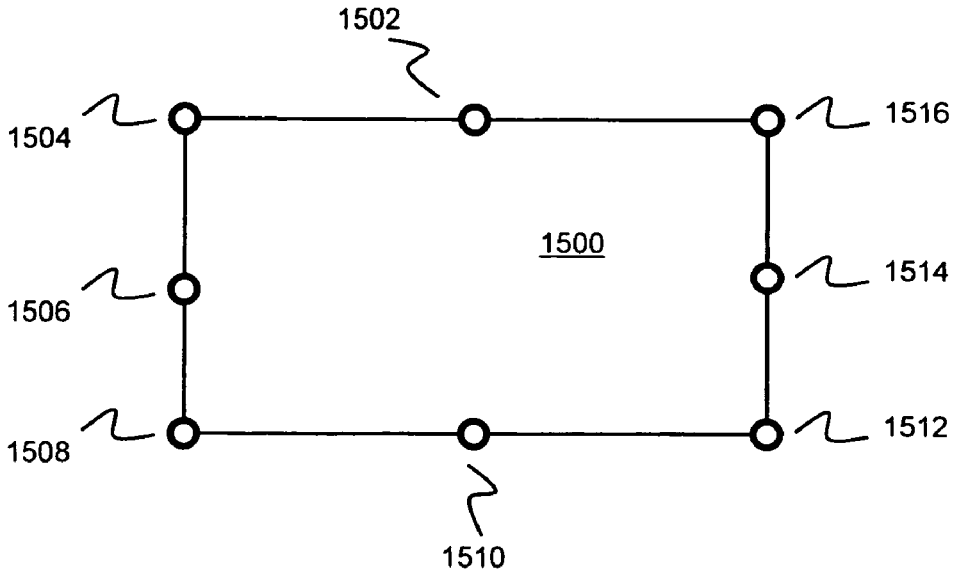
FIGS. 15A, 15B, and 15C are schematic diagrams that illustrate a microphone array in which the methods and apparatuses for capturing an audio signal based on a location of the signal are implemented.
Figure 15B:
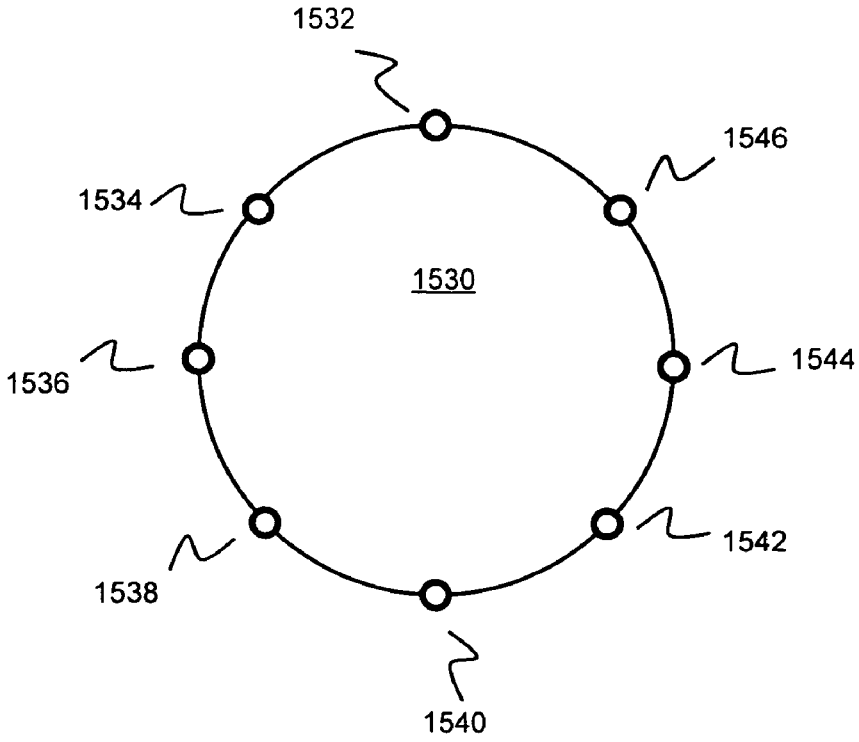
Figure 15C:
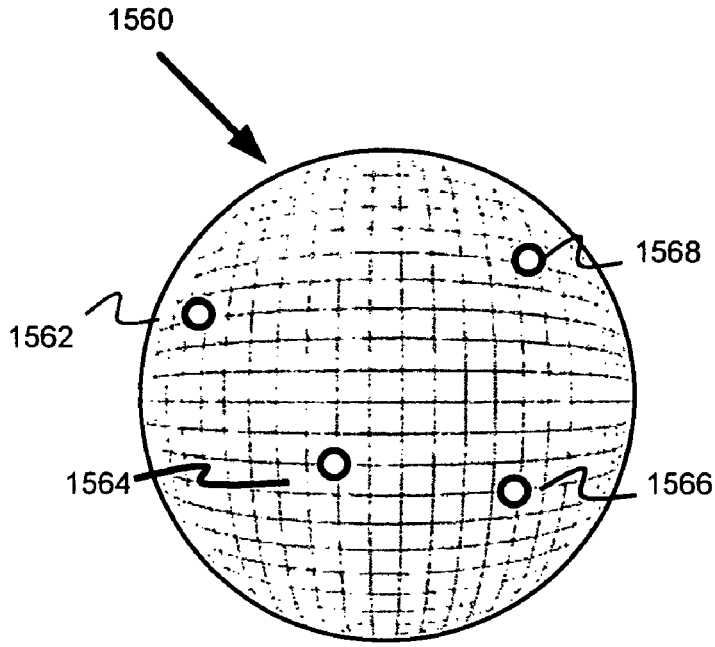

The microphone array 302 as shown within FIG. 3A illustrates one embodiment for a microphone array. FIGS. 15A, 15B, and 15C illustrate other embodiments of a microphone array.

FIG. 15A illustrates a microphone array 1510 that includes microphones 1502, 1504, 1506, 1508, 1510, 1512, 1514, and 1516. In one embodiment, the microphone array 1510 is shaped as a rectangle and the microphones 1502, 1504, 1506, 1508, 1510, 1512, 1514, and 1516 are located on the same plane relative to each other and are positioned along the perimeter of the microphone array 1510. In other embodiments, there are fewer or additional microphones. Further, the positions of the microphones 1502, 1504, 1506, 1508, 1510, 1512, 1514, and 1516 can vary in other embodiments.

FIG. 15B illustrates a microphone array 1530 that includes microphones 1532, 1534, 1536, 1538, 1540, 1542, 1544, and 1546. In one embodiment, the microphone array 1530 is shaped as a circle and the microphones 1532, 1534, 1536, 1538, 1540, 1542, 1544, and 1546 are located on the same plane relative to each other and are positioned along the perimeter of the microphone array 1530. In other embodiments, there are fewer or additional microphones. Further, the positions of the microphones 1532, 1534, 1536, 1538, 1540, 1542, 1544, and 1546 can vary in other embodiments.

FIG. 15C illustrates a microphone array 1560 that includes microphones 1562, 1564, 1566, and 1568. In one embodiment, the microphones 1562, 1564, 1566, and 1568 are distributed in a three dimensional arrangement such that at least one of the microphones is located on a different plane relative to the other three. By way of example, the microphones 1562, 1564, 1566, and 1568 may be located along the outer surface of a sphere. In other embodiments, there may be fewer or additional microphones. Further, the positions of the microphones 1562, 1564, 1566, and 1568 can vary in other embodiments.

Figure 16:
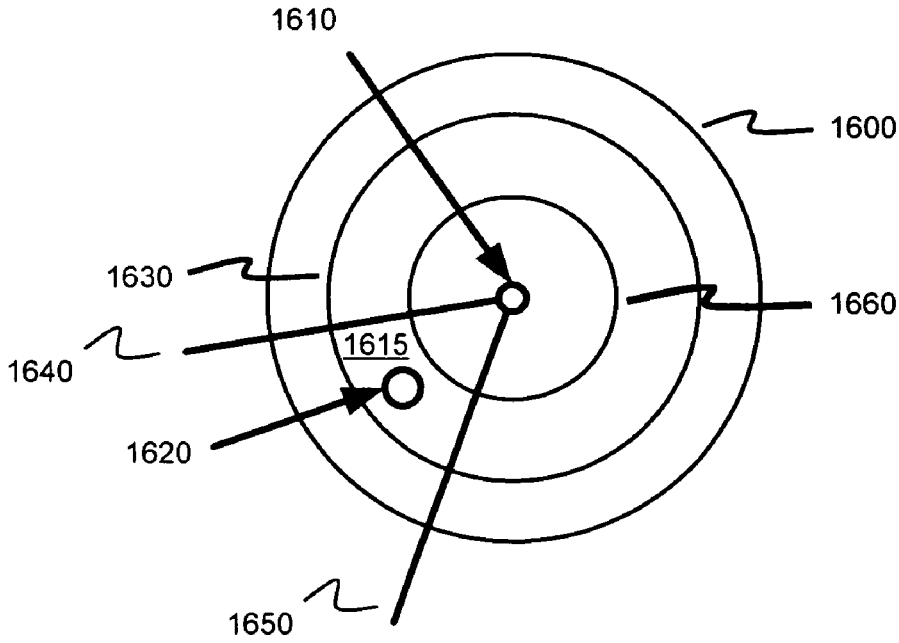
FIG. 16 is a diagram focusing sound detection consistent with one embodiment of the methods and apparatuses for capturing an audio signal based on a location of the signal.

FIG. 16 illustrates a diagram that illustrates a use of an application in conjunction with the system 600 as described within FIG. 6. FIG. 16 includes a microphone array 1610 and an object 1615. The microphone array 1610 is capable of capturing sounds within a region 1600. Further, the microphone array 1610 can adjust the listening zones for capturing sounds from the object 1615.

In one embodiment, the microphone array 1610 monitors sounds within the region 1600. When the object 1615 produces a sound that exceeds the sound level threshold a component of a controller coupled to the microphone array 1610 (e.g., area adjustment module 620 of system 600 of FIG. 6) may narrow the detection of sound to the region 1615. In one embodiment, the region 1615 is bounded by traces 11630, 1640, 1650, and 1660. Further, the region 1615 represents a three dimensional spatial volume in which sound is captured by the microphone array 1610.

In one embodiment, the microphone array 1610 utilizes a two dimensional array. For example, the microphone arrays 1500 and 1530 as shown within FIGS. 15A and 15B, respectively, are each one embodiment of a two dimensional array. By having the microphone array 1610 as a two dimensional array, the region 1615 can be represented by finite impulse response filter coefficients b0, b1 . . . , bN as a spatial volume. In one embodiment, by utilizing a two dimensional microphone array, the region 1615 is bounded by traces 11630, 1640, 1650, and 1660. In contrast to a two dimensional microphone array, by utilizing a linear microphone array, the region 1615 is bounded by traces 1640 and 1650 in another embodiment.

In another embodiment, the microphone array 1610 utilizes a three dimensional array such as the microphone array 1560 as shown within FIG. 15C. By having the microphone array 1610 as a three dimensional array, the region 1615 can be represented by finite impulse response filter coefficients b0, b1 . . . , bN as a spatial volume. In one embodiment, by utilizing a three dimensional microphone array, the region 1615 is bounded by traces 1630, 1640, 1650, and 1660. Further, to determine the location of the object 1620, the three dimensional array utilizes TDA detection in one embodiment.

The foregoing descriptions of specific embodiments of the invention have been presented for purposes of illustration and description. For example, the invention is described within the context of capturing an audio signal based on a location of the signal as merely one embodiment of the invention. The invention may be applied to a variety of other applications.

They are not intended to be exhaustive or to limit the invention to the precise embodiments disclosed, and naturally many modifications and variations are possible in light of the above teaching. The embodiments were chosen and described in order to explain the principles of the invention and its practical application, to thereby enable others skilled in the art to best utilize the invention and various embodiments with various modifications as are suited to the particular use contemplated. It is intended that the scope of the invention be defined by the Claims appended hereto and their equivalents.

What is claimed:

1. A method comprising:

detecting an initial listening zone wherein the initial listening zone represents an initial area monitored for sounds by a microphone array being positioned at a first location;

detecting an initial sound within the initial listening zone; and adjusting the initial listening zone and forming an adjusted listening zone having an adjusted area monitored for sounds by the microphone array being positioned at the first location, wherein the initial sound emanates from within the adjusted listening zone;

wherein the initial listening zone is adjusted by modifying a set of finite impulse response filter coefficients for the microphone array.

2. The method according to claim 1 further comprising capturing sounds emanating from the adjusted area.

3. The method according to claim 1 further comprising capturing sounds emanating from the initial area.

4. The method according to claim 1 wherein adjusting further comprises narrowing the initial area of the initial listening zone.

5. The method according to claim 1 further comprising detecting an initial sound level of the initial sound.

6. The method according to claim 5 further comprising comparing the initial sound level with a threshold level.

7. The method according to claim 6 wherein the threshold level is predetermined to decrease detection of background sounds.

8. The method according to claim 6 wherein adjusting the initial listening zone occurs when the initial sound level exceeds the threshold level.

9. The method according to claim 1 wherein the initial listening zone is represented by a set of filter coefficients.

10. The method according to claim 1 wherein the adjusted listening zone is represented by a set of filter coefficients.

11. The method according to claim 1 further comprising capturing an adjusted sound from the adjusted listening zone via the microphone array.

12. The method according to claim 11 further comprising transmitting the adjusted sound.

13. The method according to claim 11 further comprising storing the adjusted sound.

14. The method according to claim 11 wherein the microphone array includes more than one microphone.

15. The method according to claim 11 further comprising detecting an adjusted sound level of the adjusted sound.

16. The method according to claim 15 further comprising comparing the adjusted sound level with a threshold level.

17. The method according to claim 16 further comprising returning the adjusted listening zone to the initial listening zone when the threshold level exceeds the adjusted sound level.

18. The method according to claim 11 wherein the initial listening zone is represented by a set of filter coefficients.

19. The method according to claim 11 wherein the adjusted listening zone is represented by a set of filter coefficients.

20. A system, comprising:

an area detection module configured for detecting an initial listening zone wherein the initial listening zone is to be monitored for sounds by a microphone array being positioned at a first location;

a sound detection module configured for detecting a sound emanating from the initial listening zone and for detecting a location of the sound; and an area adjustment module configured for adjusting the initial listening zone based on the location of the sound and forming an adjusted listening zone being monitored for sounds by the microphone array being positioned at the first location, wherein the adjusted listening zone includes the location of the sound;

wherein the initial listening zone is adjusted by modifying a set of finite impulse response filter coefficients for the microphone array.

21. The system according to claim 20 wherein the adjusted listening zone is described by a set of filter coefficients.

22. The system according to claim 20 wherein the sound detection module is configured to detect a sound level of the sound emanating from the initial listening zone.

23. The system according to claim 22 wherein the area adjustment module is configured to adjust the initial listening zone based on the sound level exceeding a threshold level.

24. The system according to claim 20 further comprising a microphone coupled to the sound detection module.

25. The system according to claim 20 wherein the microphone array is coupled to the sound detection module.

26. The system of claim 20 wherein the microphone array includes a plurality of microphones arranged in a one-dimensional array.

27. The system of claim 20 wherein the microphone array includes more than two microphones arranged in a two-dimensional array.

28. The system of claim 20 wherein the microphone array includes more than three microphones arranged in a three-dimensional array.

29. A non-transitory computer-readable medium having computer executable instructions for performing a method comprising: detecting an initial listening zone wherein the initial listening zone represents an initial area monitored for sounds by a microphone array being positioned at a first location; detecting an initial sound within the initial listening zone; and adjusting the initial listening zone and forming an adjusted listening zone having an adjusted area monitored for sounds by the microphone array being positioned at the first location, wherein the initial sound emanates from within the adjusted listening zone; wherein the initial listening zone is adjusted by modifying a set of finite impulse response filter coefficients for the microphone array.

* * * * *